US005502470A

United States Patent [19]

Miyashita et al.

[11] Patent Number: 5,502,470

[45] Date of Patent: Mar. 26, 1996

[54] INK JET RECORDING HEAD AND PROCESS FOR PRODUCING THE SAME

[75] Inventors: Satoru Miyashita; Mitsuro Atobe; Yasushi Karasawa; Kiyohiko Takemoto; Yasuhiro Ouki, all of Suwa, Japan

[73] Assignee: Seiko Epson Corporation, Tokyo, Japan

[21] Appl. No.: 927,386

[22] PCT Filed: Feb. 4, 1992

[86] PCT No.: PCT/JP92/00109

§ 371 Date: Sep. 23, 1992

§ 102(e) Date: Sep. 23, 1992

[87] PCT Pub. No.: WO92/13720

PCT Pub. Date: Aug. 20, 1992

[30] Foreign Application Priority Data

| | | | |
|---|---|---|---|
| Feb. 4, 1991 | [JP] | Japan | 3-13273 |
| Mar. 22, 1991 | [JP] | Japan | 3-59127 |
| Mar. 22, 1991 | [JP] | Japan | 3-59128 |
| Apr. 16, 1991 | [JP] | Japan | 3-83751 |
| May 21, 1991 | [JP] | Japan | 3-116059 |
| May 21, 1991 | [JP] | Japan | 3-116061 |
| Jun. 18, 1991 | [JP] | Japan | 3-145957 |
| Sep. 9, 1991 | [JP] | Japan | 3-227872 |

[51] Int. Cl.[6] ..... B41J 2/135

[52] U.S. Cl. ..... 347/45

[58] Field of Search ..... 346/140 R, 1.1; 347/45, 44

[56] References Cited

U.S. PATENT DOCUMENTS

| | | | |
|---|---|---|---|
| 3,946,398 | 3/1976 | Kyser et al. | 346/140 R |
| 4,296,421 | 10/1981 | Hara et al. | 346/140 R |
| 4,368,476 | 1/1983 | Uehara et al. | 346/140 R |
| 5,121,134 | 6/1992 | Albinson et al. | 346/140 R |
| 5,148,193 | 9/1992 | Inamoto et al. | 346/1.1 |

FOREIGN PATENT DOCUMENTS

| | | |
|---|---|---|
| 58-124661 | 3/1983 | Japan . |
| 59-176059 | 10/1984 | Japan . |
| 60-178065 | 9/1985 | Japan . |
| 62-202743 | 9/1987 | Japan . |
| 63-003963 | 1/1988 | Japan . |

OTHER PUBLICATIONS

R. W. Baker "Surface Treatment . . . " IBM Technical Disclosure Bulletin, vol. 22, No. 5, Oct. 1979, N.Y.

*Primary Examiner*—N. Le
*Attorney, Agent, or Firm*—Ladas & Parry

[57] ABSTRACT

The present invention provides an ink jet recording head for use in an ink jet recording device, wherein a water-repellent layer (21) comprising a homogeneous layer of a fluoropolymer is formed on the surface of a nozzle for jetting an ink. This water-repellent layer can be formed as a dense, homogeneous layer through the use of a solvent-soluble fluoropolymer, which enables an ink jet recording head excellent in the water-repellent property, the persistence of the water repellency and the durability.

12 Claims, 9 Drawing Sheets

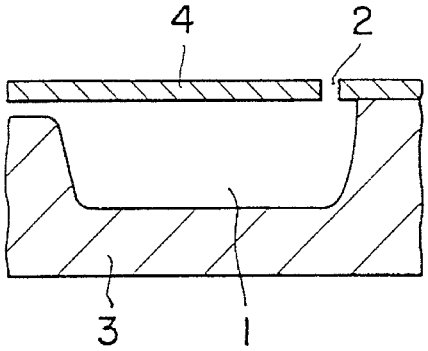
FIG. 1
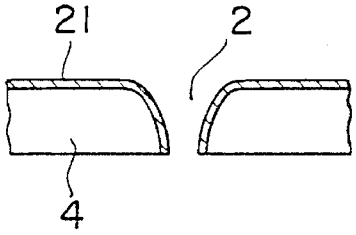
FIG. 2
FIG. 3(a)
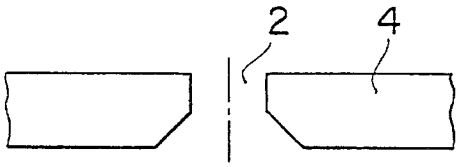
FIG. 3(b)
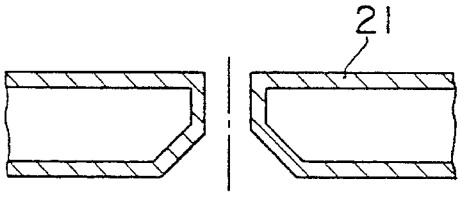
FIG. 3(c)
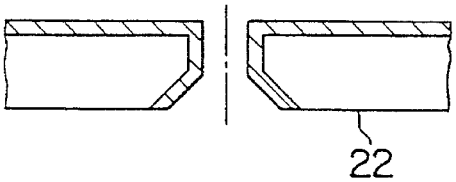

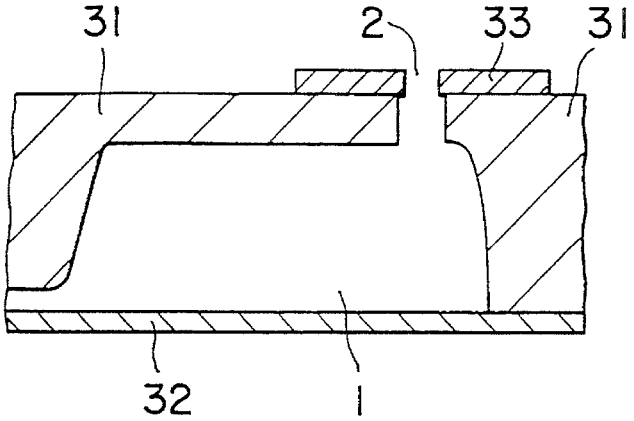
FIG. 4
FIG. 5(a)
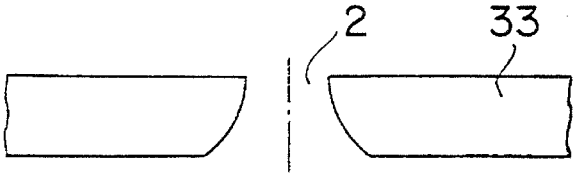
FIG. 5(b)
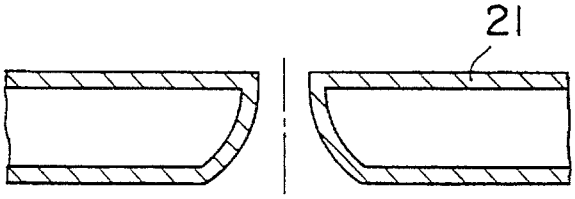
FIG. 5(c)
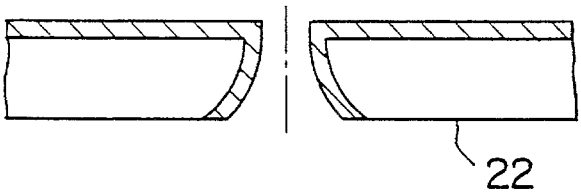
FIG. 5(d)
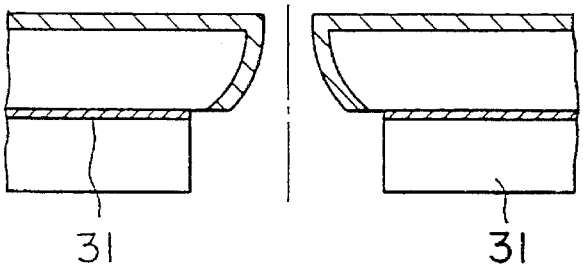

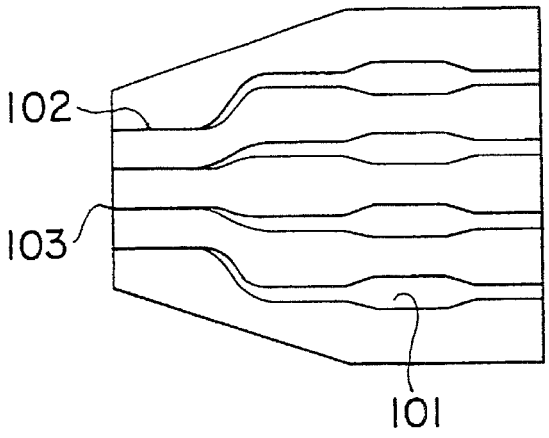
FIG. 10
FIG. 11 (a)
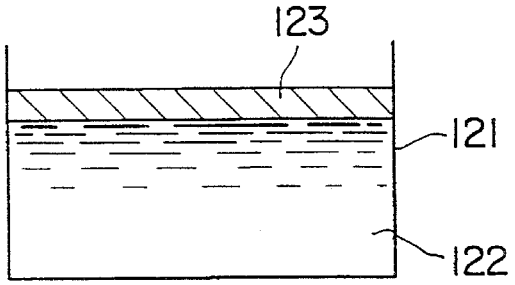
FIG. 11 (b)
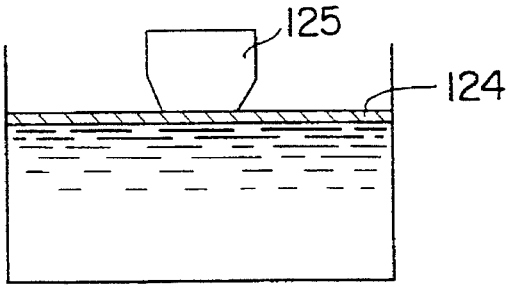
FIG. 11 (c)
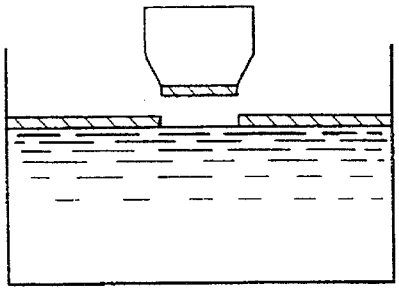

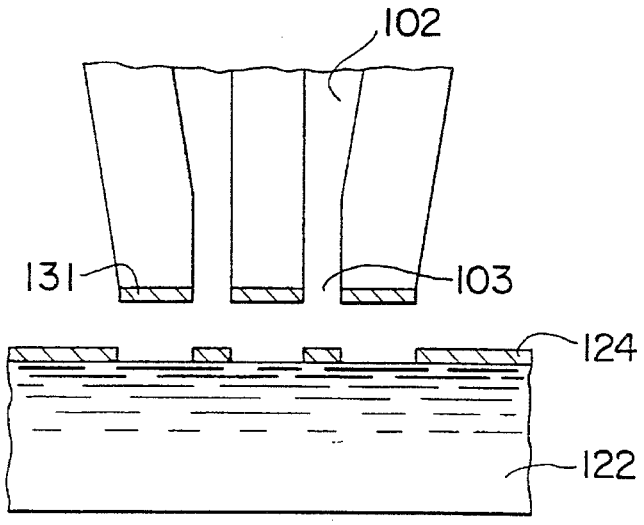
FIG. 12
FIG. 13 (a)
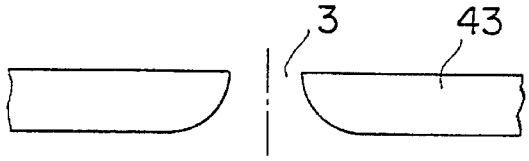
FIG. 13 (b)
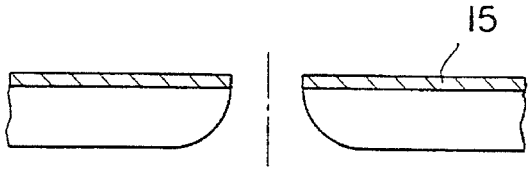
FIG. 13 (c)
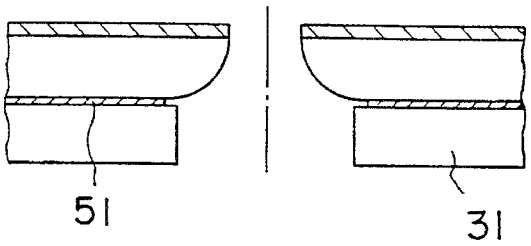

INK JET RECORDING HEAD AND PROCESS FOR PRODUCING THE SAME

TECHNICAL FIELD

The present invention relates to an ink jet recording head having an excellent water repellency for use in an ink jet recording device and a process for producing the same.

BACKGROUND ART

A material such as glass, a metal or a resin is used for an ink jet recording head.

In the use of a water-based ink in an ink jet recording head, when the water repellency of the surface of a nozzle is unsatisfactory, droplets of an ink are liable to adhere to the surface of the nozzle, which spoils the rectilinearity of jetted ink droplets, so that it often becomes impossible to conduct recording due to occurrence of troubles such as disturbance of setting.

For this reason, the surface of a nozzle which is a portion for jetting an ink has hitherto been subjected to a treatment for rendering the surface of the nozzle water-repellent. For example, a proposal has been made on a method wherein a particle of a water-repellent material is deposited on the surface of a nozzle, for example, by electrostatic powder coating (see Japanese Patent Application Laid-Open No. 157765/1982) and vacuum deposition and plasma polymerization (see Japanese Patent Application Laid-Open Nos. 183161/1985 and 176059/1984) to render the surface of the nozzle water-repellent.

In the above-described conventional treatment for rendering the surface of the nozzle water-repellent, it is not always easy to form a smooth repellent surface free from any defect such as a pinhole. This causes properties to be varied from product to product, and the properties to change with the elapse of time. Further, in the electrostatic powder coating, the baking temperature should be 300° C. or above. In the case of a metal, the dimensional accuracy is spoiled, and it is impossible to apply this method to a resin. When use is made of vacuum deposition, a large device should be used and it is difficult to conduct the process control. Further, in this method, since the bonding strength is insufficient, only a product having an insufficient bonding strength can be obtained.

The present invention can solve the above-described problem, and an object of the present invention is to provide an ink jet recording head which is excellent in the water repellency of the surface of the nozzle, the persistence of the water repellency and the durability and enables a high printing quality to be maintained for a long period of time, and a process for producing the same.

DISCLOSURE OF THE INVENTION

The above-described object can be attained by an ink jet recording head for use in an ink jet recording device, wherein a water-repellent layer comprising a homogeneous layer of a fluoropolymer is formed on the surface of a nozzle for jetting an ink. The ink jet recording head having an excellent water-repellent property can be produced by forming the above-described water-repellent layer comprising a fluoropolymer on the surface of a nozzle for jetting a nozzle by coating or transfer through the use of a solvent-soluble fluoropolymer solution.

In the treatment for rendering the surface of the nozzle water-repellent, since the contact angle of water to the surface of the nozzle should be at least 90°, preferably at least 100°, the polarizability is so small that it is useful to introduce fluorine having a remarkably small inter-molecular cohesive force. Although a fluoropolymer represented by polytetrafluoroethylene has excellent features such as heat resistance, chemical resistance and weather resistance, it is insoluble in a solvent, so that only powder coating can be applied to the fluoropolymer. This makes it possible to attain a good water-repellent property.

BRIEF DESCRIPTION OF DRAWINGS

FIGS. 1 and 4 are schematic cross-sectional views of ink jet recording heads according to embodiments of the present invention;

FIG. 2 is a partially enlarged cross-sectional view of an ink jet nozzle;

FIG. 3 is a typical cross-sectional view showing the steps of treatment for rending the surface of a nozzle water-repellent, FIG. 3(*a*) is an enlarged he vicinity of the nozzle and a nozzle plate, FIG. 3 (*b*) shows a state obtained when "Teflon AF" is dissolved in a fluorocarbon solvent and coated on the whole surface of a nozzle plate, FIG. 3(*c*) shows a state obtained when the reverse surface of the nozzle plate was ground;

FIG. 4 is a typical cross-sectional view of an embodiment of an ink jet recording head;

FIG. 5 is a typical cross-sectional view showing the steps of a treatment for rendering the surface of a nozzle water-repellent, FIG. 5(*a*) is an enlarged view of the vicinity of a nozzle in a nozzle plate comprising nickel prior to treatment, FIG. 5(*b*) shows a state obtained when "CYTOP" is dissolved in a fluorocarbon solvent and coated on the whole surface of the nozzle plate through dipping, FIG. 5(*c*) shows a state obtained when the reverse surface of the nozzle plate was ground, FIG. 5(*d*) shows a state obtained when the nozzle plate subjected to the treatment and a first substrate are bonded together with an adhesive;

FIG. 10 is a schematic view of an ink jet recording head;

FIG. 11 is a typical cross-sectional view showing the steps of treatment for rendering the surface of a nozzle water-repellent, FIG. 11(*a*) shows a state obtained when "Teflon AF" is dissolved in a fluorocarbon solvent and the solution spread on the surface of water, FIG. 11(*b*) shows a state obtained when the surface of a nozzle comprising acrylic resin is brought into contact with the water surface spread film, FIG. 11(*c*) shows a state obtained when a nozzle is pulled up from the surface of water to transfer a water surface spread film of a fluoropolymer to a surface of the nozzle;

FIG. 12 is an enlarged view of a nozzle for jetting ink shown in FIG. 11(*c*);

FIG. 13 is a typical cross-sectional view showing the steps of rendering the surface of the nozzle water-repellent, FIG. 13(*a*) is an enlarged view of the vicinity of the nozzle in a nozzle plate comprising nickel prior to treatment, FIG. 13(*b*) shows a state obtained when "CYTOP" is dissolved in a fluorocarbon solvent and spread on the surface of water, FIG. 13(*c*) shows a state obtained when the nozzle plate subjected to the treatment and a first substrate are bonded together with an adhesive;

BEST MODE FOR CARRYING OUT THE INVENTION

Figure 6A:
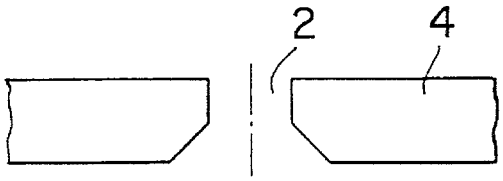
FIG. 6 is a typical cross-sectional view showing the steps and treatment for rendering the surface of the nozzle water-repellent, FIG. 6(*a*) is an enlarged view of the vicinity of the nozzle and a nozzle plate of polysulfone resin prior to treatment, FIG. 6(*b*) shows a state obtained when a reverse surface of the nozzle plate and the inside of the nozzle is spin coated with a resist, FIG. 6(*c*) shows the step of irradiating the nozzle plate, FIG. 6(*d*) shows a state obtained when the nozzle plate is developed to leave the resist layer only on the reverse surface of the nozzle plate, FIG. 6(*e*) shows a state obtained when "Teflon AF" is dissolved in a fluorocarbon solvent and coated through dipping on the whole surface of the nozzle plate, FIG. 6(*f*) shows a state obtained when the resist layer and the fluoropolymer layer on the reverse surface of the nozzle plate are removed through the use of a resist peeling solution.
Figure 6B:
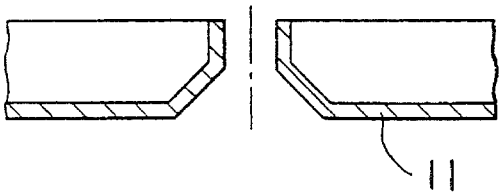
Figure 6C:
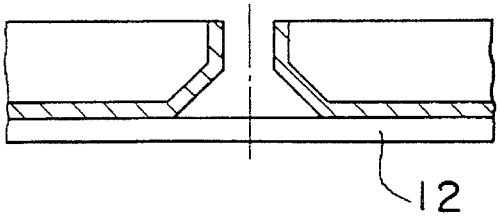
Figure 6D:
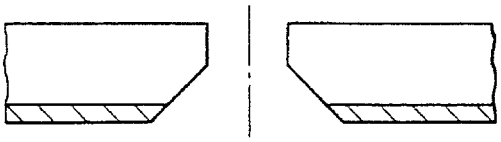
Figure 6E:
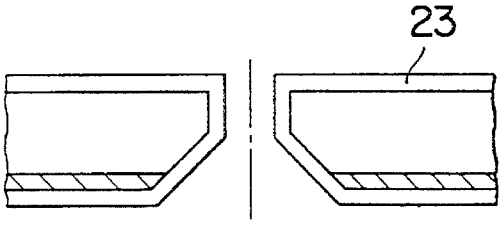
Figure 6F:
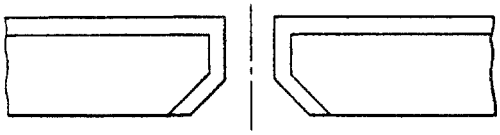
Figure 7A:
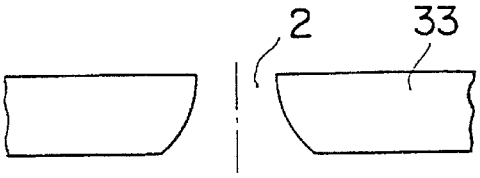
FIG. 7 is typical cross-sectional view showing the steps for treatment for rendering the surface of the nozzle water-repellent, FIG. 7(*a*) is an enlarged view of the vicinity of a nozzle in a nozzle plate comprising nickel prior to treatment, FIG. 7(*b*) shows a state obtained when a positive-working resist is formed through dip coating and prebaked to form a resist layer, FIG. 7(*c*) shows the step of irradiating the nozzle plate, FIG. 7(*d*) shows a state obtained when the exposed nozzle plate is developed, FIG. 7(*e*) shows a state obtained when "CYTOP" is dissolved in a fluorocarbon solvent and coated on the whole surface of the nozzle plate through dipping, FIG. 7(*f*) shows a state obtained after the resist layer and fluoropolymer layer on the reverse surface of the nozzle plate are removed through the use of a resist peeling solution and the nozzle plate and a first substrate are bonded together with an adhesive.
Figure 7B:
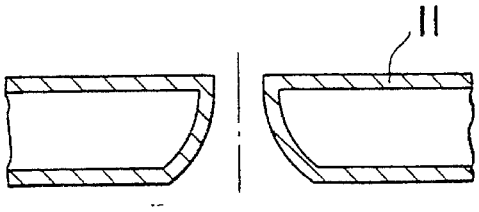
Figure 7C:
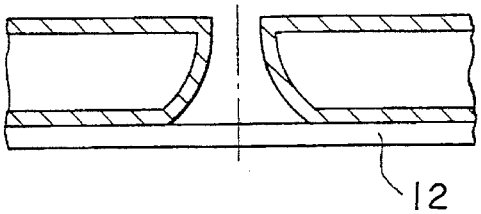
Figure 7D:
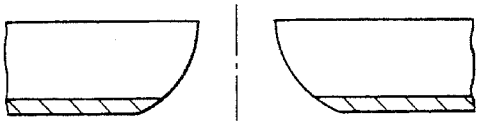
Figure 7E:
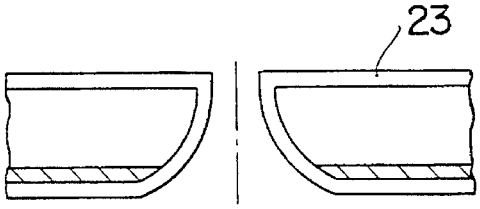
Figure 7F:
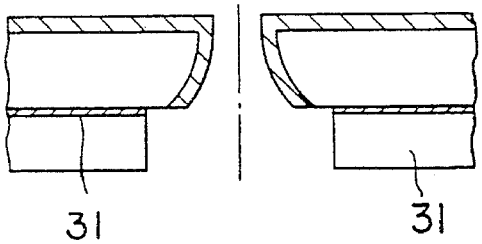
Figure 8A:
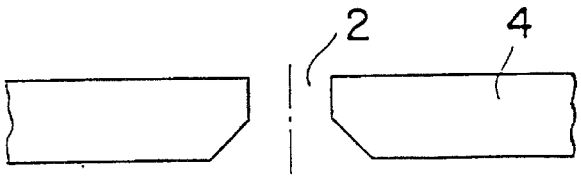
FIG. 8 is a typical cross-sectional view showing the steps of treatment for rendering the surface of the nozzle water-repellent, FIG. 8(*a*) is an enlarged view of the vicinity of the nozzle and a nozzle plate comprising polysulfone resin prior to treatment, FIG. 8(*b*) shows a state obtained when a "Teflon AF" is dissolved in a fluorocarbon solvent and coated on the whole surface of the nozzle plate through dipping, FIG. 8(*c*) shows a state obtained when a photoresist is coated through dipping and baked without exposure, FIG. 8(*d*) shows a state obtained when the reverse surface of the nozzle is ground.
Figure 8B:
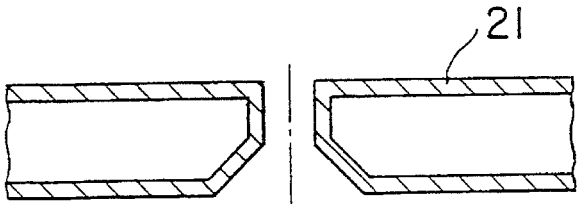
Figure 8C:
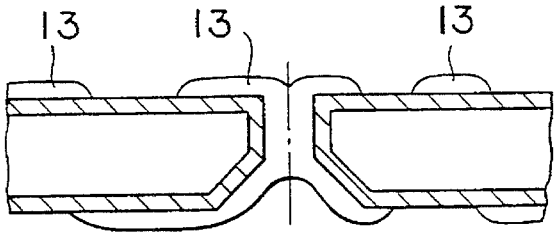
Figure 8D:
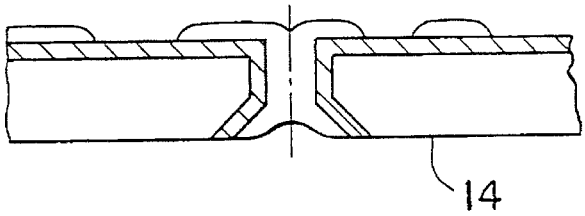
Figure 8E:
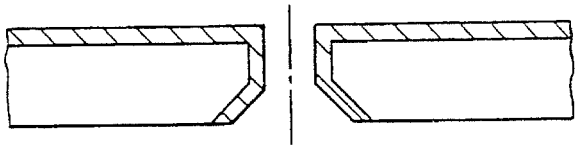
Figure 9A:
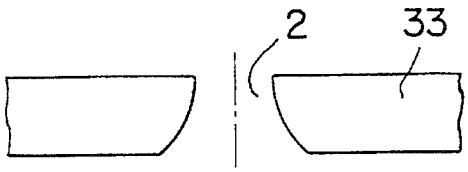
FIG. 9 is a typical cross-sectional view of an embodiment of an ink jet recording head, FIG. 9(*a*) is an enlarged view of the vicinity of the nozzle and a nozzle plate comprising nickel prior to treatment, FIG. 9(*b*) shows a state obtained when "CYTOP" is dissolved in a fluorocarbon solvent and coated on the whole surface of the nozzle plate through dipping, FIG. 9(*c*) shows a state obtained when an acrylic resin is dissolved in acetone and coated several times through dipping to form a coating, FIG. 9(*d*) shows a state when the reverse surface of the nozzle plate is ground, FIG. 9(*e*) shows a state obtained when the nozzle plate is exposed to an ultrasonic wave and the acrylic resin and protective layer are removed, FIG. 9(*f*) shows a state obtained when the nozzle plate subjected to the treatment and a first substrate are bonded together with an adhesive.
Figure 9B:
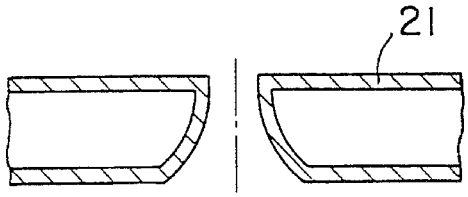
Figure 9C:
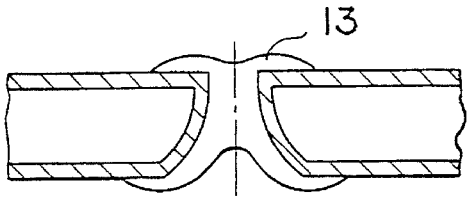
Figure 9D:
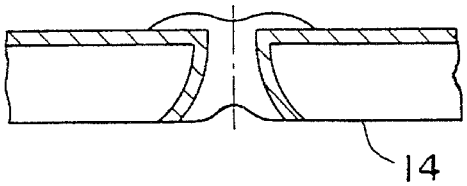
Figure 9E:
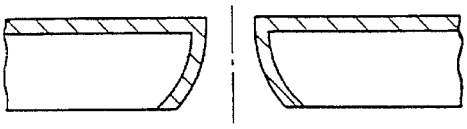
Figure 9F:
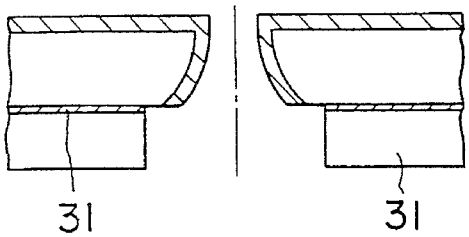

Embodiments of the present invention will now be described.

The ink jet recording head according to the present invention is mounted on an ink jet recording device and characterized in that a water-repellent layer comprising a homogeneous layer of a fluoropolymer is formed on the surface of a nozzle for jetting an ink.

The above-described water-repellent layer is formed through the use of a solvent-soluble fluoropolymer. The solvent-soluble fluoropolymer is preferably amorphous. Specific preferred examples of the solvent-soluble fluoropolymer include polydiperfluoroalkyl fumarate, Teflon AF (trademark, De Pont (E. I.) de Nemours & Co), solvent-soluble fluoropolymers such as CYTOP (trademark, Asahi Glass Co., ltd.) and alternating copolymers of fluoroethylenes with hydrocarbon ethylenes such as an alternating copolymer of diperfluoroalkyl fumarate with styrene, an alternating copolymer of ethylene trifluoride chloride with a vinyl ether and an alternating copolymer of ethylene tetrafluoride with a vinyl ester, and their analogues and derivatives.

Preferred examples of the solvent include fluorinated liquids include Fluorinert (trademark, 3M Co.), Garden (trademark, Montefluos), trifluoromethylbenzene and hydrochlorofluorocarbon.

The concentration of the fluoropolymer in the fluoropolymer solution is preferably 0.01 to 7% by weight, still preferably 0.1 to 5% by weight.

Since the above-described fluoropolymer is solvent-soluble, it is possible to form a water-repellent layer through the use of the fluoropolymer in a solution form according to a coating method or a transfer method. The water-repellent layer thus formed comprises a dense, homogeneous film comprising a homogeneous layer or continuous layer of a fluoropolymer, and it is believed that such a film structure contributes to a remarkable improvement in the water-repellent property and the persistence of the effect of water repellency.

In the present invention, it is also possible to form a water-repellent layer through a coupling compound layer for the purpose of further improving the adhesion between the water repellent layer and the surface of the nozzle.

A further feature of the present invention is that the water-repellent layer can be formed by simple and rapid methods, for example, a coating method such as dipping and a transfer method which will be described later.

Specifically, the process for producing an ink jet recording head according to the present invention comprises subjecting the surface of a nozzle for jetting an ink of an ink jet recording head to a treatment for rendering the surface of the nozzle water-repellent, characterized,in that the process comprises the steps of: preparing a polymer solution of a fluoropolymer dissolved in a solvent; coating through dipping said polymer solution on the whole surface of a nozzle plate provided with an ink jet hole to form a water-repellent layer comprising a fluoropolymer on the whole surface of the nozzle plate; and removing through grinding the water-repellent layer on the reverse surface (the opposite side of a side from which an ink is jetted) of the nozzle plate in the water-repellent layer formed on each surface of the nozzle plate.

According to another embodiment of the process of the present invention, the process may further comprise, after forming the water-repellent layer on the whole surface of the nozzle plate, forming a protective layer on only at least the inside or vicinity of the jet hole of the nozzle, removing through grinding the water-repellent layer on the reverse surface (the opposite side of a side from which an ink is jetted) of the nozzle plate in the water-repellent layer formed on each surface of the nozzle plate and removing said protective layer.

According to another aspect of the present invention, there is provided a process for producing an ink jet recording head, comprising subjecting the surface of a nozzle for jetting an ink of an ink jet recording head to a treatment for rendering the surface of the nozzle water-repellent, characterized in that the process comprises the steps of: coating a positive-working resist on at least the reverse surface (the opposite side of a side from which an ink is jetted) of a nozzle plate provided with an ink jet hole; irradiating the nozzle plate with an ionizing radiation from the surface side of the nozzle plate with the reverse surface side being light-shielded; developing the irradiated surface and removing the resist from the surface of the nozzle plate and the inside of the nozzle hole; coating through dipping a polymer solution containing a fluoropolymer dissolved therein on the whole surface of the nozzle plate to form a water-repellent layer comprising a fluoropolymer on the whole surface of the nozzle plate; and removing the resist layer and the water-repellent layer on the reverse surface side of the nozzle plate to form a water-repellent layer on only the surface side of the nozzle plate and the internal surface of the nozzle hole.

when use is made of transfer, the process for producing an ink jet recording head according to the present invention comprises subjecting the surface of a nozzle for jetting an ink of the ink jet recording head to a treatment for rendering the surface of the nozzle water-repellent, characterized in that the process comprises the steps of: forming a polymer layer comprising a polymer solution containing a fluoropolymer dissolved therein on the surface of a transfer medium; and transferring the polymer layer formed on the transfer medium to a predetermined portion of the surface of the nozzle provided with an ink jet hole. When the transfer is conducted a plurality of times, the densiness can be increased, so that a film having a desired thickness can be formed.

In the above-described process wherein use is made of transfer, it is possible to use a water surface spreading method which comprises spreading a polymer solution containing a fluoropolymer dissolved therein on the surface of water, evaporating a solvent contained in the polymer solution and bringing the spread film into contact with the surface of a nozzle. When the transfer of the water surface spread film is conducted a plurality of times, a film having a desired thickness can be formed.

In the process wherein use is made of transfer, a more homogeneous and dense water-repellent layer can be formed by conducting a drying and heating treatment after the transfer of the polymer layer.

Further, in the present invention, it is possible to use a method for forming a Langmuir Blodgett film on the surface of a nozzle which comprises spreading a polymer solution containing a fluoropolymer dissolved therein on the surface of water, evaporating the solvent, moving a barrier to form a Langmuir film from the resultant spread film and bringing the resultant Langmuir film into contact with the surface of the nozzle.

In the above-described Langmuir Blodgett film, at least one layer may be laminated to a desired thickness. A more homogeneous and dense water-repellent layer can be formed by conducting a heat treatment after the transfer of the Langmuir Blodgett film.

In the transfer method, when an elastic body, such as rubber, is used as a transfer medium, in order to form a good water-repellent film, it is important to bring the surface of the transfer medium to a smooth state. The treatment of the surface of the head according to the transfer method is disclosed in Japanese Patent Application Laid-Open No. 48953/1990. This method is characterized in that use is made of a transfer medium comprising a porous material. The present inventors, however, have found that although the method wherein the transfer is conducted through the use of a porous transfer medium is excellent in the transfer efficiency, it is not always useful for forming a homogeneous, dense water-repellent layer having an excellent water-repellent property contemplated in the present invention and, as described above, the method wherein the surface of the transfer medium is brought to a smooth state is useful for this purpose. As described above, when the surface of the transfer medium (support) is brought to a smooth state, the peelability of the polymer layer from the transfer medium unexpectedly becomes so good that the polymer layer can be made thick and homogeneous.

Prior to the transfer of the polymer layer, a coupling compound layer can be formed on the surface of the nozzle, and a combination of the transfer method with the formation of the coupling compound layer enables a water-repellent layer having an excellent adhesion and a large thickness to be formed. Methods of rendering the surface of the nozzle water-repellent including a method of forming a coupling compound layer will now be described.

At the outset, the nozzle plate is immersed in a coupling solution comprising a coupling compound and a solvent and then in a solvent. The immersion of the nozzle plate in a solvent advantageously has the effect of making the thickness of coating of the coupling compound uniform to further stabilize the adhesion between the water-repellent layer and the surface of the nozzle plate.

Water and alcohols, such as methanol and ethanol, can be used as the solvent for the coupling solution. When water is used as the solvent, the handleability becomes better. Further, since the surface tension is so large that it is possible to prevent the coupling compound from penetrating into the hole in the nozzle.

Then, the coupling coating layer is dried, and a water-repellent layer is transferred thereon. In the transfer method, an elastic body having a specular surface, for example, a silicone rubber, a urethane rubber, a butyrene rubber, gelatin or a chloroprene rubber is used as the transfer medium. The above-described fluoropolymer solution is coated on the surface of the transfer medium by spin coating or uniform pull-up immersion, and a nozzle plate is pressed against the coated surface to transfer the polymer layer to the surface of the nozzle plate.

The transferred polymer layer is then baked. It is preferred to conduct the baking at a temperature not below the glass transition point of the polymer. The baking enables the volatile solvent contained in the polymer layer to be completely removed. Further, the present inventors have found that the heating of the transferred polymer layer to a temperature not below the glass transition point of the polymer leads to an increase in the fluidity of the polymer layer which improves the coating property and further contributes to an improvement in the adhesion.

Further, in the above-described method, the following procedure may be used. After exposure of the surface of the nozzle plate to an ozone atmosphere, a coupling layer is formed, and a water-repellent layer is then formed. Alternatively, after the formation of the coupling layer, the surface of the coupling layer may be exposed to an ozone atmosphere followed by the formation of a water-repellent layer. The surface cleaning treatment wherein use is made of ozone removes stains on the surface, which contributes to a further improvement in the adhesion of the formed layer. The ozone atmosphere can be formed by irradiation with oxygen plasma or ultraviolet rays.

The present invention will now be described in more detail with reference to the following embodiments.

Embodiment A

FIG. 1 is a typical cross-sectional view of an embodiment of an ink jet recording head. Numeral 1 designates a pressure chamber which is a portion for obtaining a pressure used in the ejection of an ink by means of a PZT element or a heating element. Numeral 2 designates an ink jet nozzle. Numeral 3 designates a first substrate provided with a pattern groove for an ink passage. Numeral 4 designates a nozzle plate. An ink passage is formed by laminating both members on top of the other.

Example A1

A polydiperfluoroalkyl fumarate was dissolved in a fluorocarbon solvent, and the solution was spin-coated on the surface of a nozzle in a nozzle plate comprising a polysulfone resin. Although the concentration of the solution and the film thickness can be suitably selected, in this example, a solution having a concentration of 0.3% by weight was coated at 3000 rpm for one min, and the coating was dried at 80° C. to form a polydiperfluoroalkyl fumarate layer having a thickness of 300 Å. The observation under a microscope has revealed that the formed thin film was very dense and homogeneous. The film had a contact angle of 115° to water, that is, a high water repellency.

A first substrate of a polysulfone resin and the nozzle plate subjected to a treatment for rendering it water-repellent were washed and dried, and bonded to each other at 80° C. through a solvent cement of the same polysulfone resin dissolved in a solvent, thereby assembling an ink jet recording head. The appearance of the vicinity of the cross section of the recording head is shown in FIG. 2. Numeral 21 designates a fluoropolymer layer formed by coating.

The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in an ink at 70° C. for 5 days, and a setting test was conducted in the same manner as that described above. The setting quality was the same as the initial property. That is, the recording head maintained a sufficient ink resistance. A rubbing test was conducted through the use of a silicone rubber. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example A2

A solvent-soluble fluoropolymer (CYTOP manufactured by Asahi Glass Co., Ltd.) was dissolved in a fluorinated liquid, and the solution was coated through dipping on the surface of a nozzle plate comprising nickel. The portions unnecessary to be rendered water-repellent were previously masked by taping, resist or the like.

A first substrate of a polycarbonate resin and the nozzle plate subjected to a treatment for rendering it water-repellent and removal of the mask were washed and dried, and then bonded to each other, thereby assembling an ink jet recording head. The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in an ink at 70° C. for 5 days, and a setting test was conducted in the same manner as that described above. The setting quality was the same as the initial property. That is, the recording head maintained a sufficient ink resistance. A rubbing test was conducted through the use of a silicone rubber. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example A3

A fluoroethylene/vinyl ether copolymer was dissolved in trifluoromethylbenzene, and the solution was spin-coated on the surface of a nozzle plate comprising a polyethersulfone resin. Although the concentration of the solution and the film thickness can be suitably selected, in this example, a solution having a concentration of 1% by weight was coated at 3000 rpm for one min, and the coating was dried at 120° C. to form a fluoroethylene/vinyl ether copolymer layer having a thickness of 500 Å. The observation under a microscope has revealed that the formed thin film was very dense and homogeneous. The film had a contact angle of 105° to water, that is, a high water repellency.

A substrate of a polyethersulfone resin and the nozzle plate subjected to the surface treatment were washed and dried, and bonded to each other, thereby assembling an ink jet recording head. The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in an ink at 70° C. for 5 days, and a setting test was conducted in the same manner as that described above. The setting quality was the same as the initial property. That is, the recording head maintained a sufficient ink resistance. A rubbing test was conducted through the use of a silicone rubber. As a result, the contact angle of the recording head to water was 95° or more after rubbing the recording head 5000 times. Thus, an ink jet recording head which gives rise to substantially no deterioration of the water repellency and can provide a high setting quality for a long period of time could be realized.

The present invention was described above with reference to examples. Materials used in the ink jet recording head and structures of the ink jet recording head and the kind of the fluoropolymer layer formed on the surface of the nozzle may be varied and are not particularly limited. Further, there is no particular limitation on the solvent for the fluoropolymer and the coating method.

As described above, the present invention can provide an ink jet recording head capable of providing a high setting quality through an effective and homogeneous treatment for rendering the surface of the nozzle water-repellent. Further, the treatment for rendering a recording head water-repellent according to the present invention is very excellent in the persistence of the water repellency, which contributes to a prolongation of the service life of the recording head.

Further, in the process for producing an ink jet recording head, since the treatment for rendering the recording head water-repellent can be conducted through the use of a very simple apparatus and step, the production can be safely conducted and the cost can be remarkably reduced, which renders the effect of the present invention large.

Embodiment B

In recent years, a copolymer of a solvent-soluble polymer with a fluoropolymer and a synthetic polymer having a special fluorine-containing side chain have become prepared. Since these materials can substantially maintain properties of the conventional fluoropolymers and are soluble in a solvent, it is possible to easily obtain a smooth surface free from a pinhole through coating. However, the present inventors have found that when a hydrocarbon molecule site is present in the fluoropolymer, a water-repellent deterioration is liable to occur due to a partial deposition of a dye molecule contained in the ink.

The present invention has been made with a view to solving the above-described problem, and an object of the present invention is to provide an ink jet recording head wherein the surface of the nozzle in the ink jet recording head has a high water repellency and is excellent in the persistence of the effect of water repellency and a high setting quality can be provided for a long period of time.

The above-described object can be attained by an ink jet recording head for use in an ink jet recording apparatus, wherein a layer of a polymer which is soluble in a solvent and contains fluorine bonded to substantially all the molecular ends is formed on the surface of a nozzle for jetting an ink.

In the treatment for rendering the surface of the nozzle water-repellent, since the contact angle of water to the surface of the nozzle should be at least 90°, preferably at least 100°, the polarizability is so small that it is indispensable to introduce fluorine having a remarkably small intermolecular cohesive force. Further, in the treatment for rendering the surface of the nozzle water-repellent, a high ink repellency and a high adhesion are separately required.

The fluoropolymer represented by polyethylene tetrafluoride has excellent features such as heat resistance, chemical resistance and weather resistance. It, however, is insoluble in a solvent, so that, as described above, only powder coating can be applied thereto. Therefore, not only the film strength is low, but also the adhesion at the interface is remarkably low. Even though the polymer contains fluorine bonded to all the molecular ends, it can be made solvent-soluble through introduction of an ether or ester bond into the molecular chain. The coating of the polymer solution enables a smooth surface free from a pinhole to be easily obtained, so that a thin film having a high strength can be formed. In order to attain a film strength and a bonding strength between the film and the substrate derived from the film strength, it is indispensable for the molecular weight to be increased prior to the formation of the film.

An ink is a solution of an organic molecule as a dye dissolved in water or a colloid comprising a pigment (mainly a carbon black) dispersed in water. In a conventional solvent-soluble fluoropolymer, since a hydrocarbon molecule portion is present, the dye molecule or pigment is deposited on the hydrocarbon molecule portion, so that there occurs a deterioration in the water repellency. In a polymer wherein fluorine is bonded to all,the molecular ends, the surface of the polymer is water-repellent and oil-repellent due to the exclusion effect of the site of fluorine, which enables the deposition of all the molecules to be prevented for a long period of time.

Example B1

"Teflon AF" (manufactured by E. I. du Pont de Nemours & Co.) was dissolved in a fluorocarbon solvent and spin-coated on the surface of a nozzle in a nozzle plate comprising a polysulfone resin.

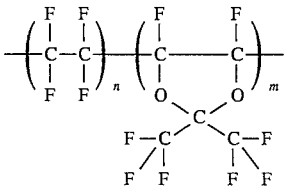

Although the concentration of the solution and the film thickness can be suitably selected, in this example, a solution having a concentration of 0.3% by weight was coated at 3000 rpm for one min, and the coating was dried at 80° C. to form a 300 Å-thick polymer layer which is soluble in a solvent and contains fluorine bonded to substantially all the molecular ends. The observation under a microscope has revealed that the formed thin film was very dense and homogeneous. The film had a contact angle of 105° to water, that is, a high water repellency.

A first substrate of a polysulfone resin and the nozzle plate subjected to a treatment for rendering it water-repellent were washed and dried, and then bonded to each other at 80° C. through a solvent cement of the same polysulfone resin dissolved in a solvent, thereby assembling an ink jet recording head. The appearance of the vicinity of the cross section of the recording head is shown in FIG. 2. Numeral 21 designates a "Teflon AF" polymer layer formed by coating.

The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in an ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a dye ink. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example B2

"CYTOP" manufactured by Asahi Glass Co., Ltd. was dissolved in a fluorinated liquid, and the solution was coated through dipping on the surface of a nozzle plate comprising nickel. The portions unnecessary to be rendered water-repellent were previously masked by taping, resist or the like. Although the concentration of the solution and the film thickness can be suitably selected, in this example, the nozzle plate was pulled up from a solution having a concentration of 0.1% by weight at a rate of 10 cm/min, and the coating was dried at 180° C. to form a 0.1 μm-thick polymer layer which is soluble in a solvent and contains fluorine bonded to substantially all the molecular ends. The observation under a microscope has revealed that the formed thin film was very dense and homogeneous. The film had a contact angle of 110° to water, that is, a high water repellency.

A firsts. Substrate of a polycarbonate resin and the nozzle plate subjected to a treatment for rendering it water-repellent and removal of the mask were washed and dried, and then bonded to each other with an adhesive, thereby assembling an ink jet recording head. The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in an ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a dye ink. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example B3

"CYTOP" manufactured by Asahi Glass Co., Ltd. was dissolved in a fluorinated liquid, and the solution was spin-coated through dipping on the surface of a nozzle plate comprising a polyethersulfone. Although the concentration of the solution and the film thickness can be suitably selected, in this example, a solution having a concentration of 1% by weight was coated at 2000 rpm for one min, and the coating was dried at 120° C. to form a 500 Å-thick polymer layer which is soluble in a solvent and contains fluorine bonded to substantially all the molecular ends. The observation under a microscope has revealed that the formed thin film was very dense and homogeneous. The film had a contact angle of 110° to water, that is, a high water repellency.

A first substrate of a polyethersulfone resin and the nozzle plate subjected to a treatment for rendering it water-repellent were washed and dried, and bonded to each other through a solvent for the polyethersulfone rein, thereby assembling an ink jet recording head. The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in an ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a dye ink. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

The present invention was described above with reference to examples. Materials used in the ink jet recording head and structures of the ink jet recording head and the kind of the polymer layer soluble in a solvent and containing fluorine bonded to substantially all the molecular ends formed on the surface of the nozzle may be varied and are not particularly limited. Further, there is no particular limitation on the solvent for the fluoropolymer and the coating method.

As described above, the present invention can provide an ink jet recording head capable of providing a high setting quality through an effective and homogeneous treatment for rendering the surface of the nozzle water-repellent. Further, the treatment for rendering a recording head water-repellent according to the present invention is excellent in the persistence of the water repellency which contributes to a prolongation of the service life of the recording head.

Embodiment C

In the ink jet recording head according to the embodiment C, a polymer layer comprising the following alternating polymer of a fluoroethylene with a hydrocarbon ethylene or its analogue is formed on the surface of a nozzle for jetting an ink.

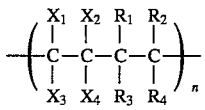

wherein $X_1$ to $X_4$ each stand for a fluorine or perfluoroalkyl group, and $R_1$ to $R_4$ each stand for a hydrocarbon substituent (containing a hydrogen or a halogen).

In the treatment for rendering the surface of the nozzle water-repellent, since the contact angle of water to the surface of the nozzle should be at least 90°, preferably 100° or more, the polarizability is so small that it is indispensable to introduce fluorine having a remarkably small inter-molecular cohesive force. Further, in the treatment for rendering the surface of the nozzle water-repellent, a high ink repellency and a high adhesion are separately required.

The fluoropolymer represented by polyethylene tetrafluoride has excellent features such as heat resistance, chemical resistance and weather resistance. It, however, is insoluble in a solvent, so that, as described above, only powder coating can be applied thereto. Therefore, not only the film strength is low, but also the adhesion at the interface is remarkably low. Since the alternating copolymer of a fluoroethylene with a hydrocarbon ethylene is soluble in a solvent, it is possible to easily form a smooth surface free from a pinhole through coating, which enables a thin film having a high strength to be formed. Further, since a hydrocarbon ethylene portion is evenly contained on a molecular level within the polymer, it is possible to attain a sufficient bonding strength between the polymer and the metal or resin constituting the nozzle. In order to attain a film strength or a bonding strength, it is indispensable for the molecular weight to be increased prior to the formation of the film.

An ink is a solution of a dye molecule having a molecular weight of several hundreds dissolved in water or a colloid comprising a pigment (mainly a carbon black) having a primary particle diameter of several hundreds Å dispersed in water. In the usually prepared random copolymer, since a polymer portion wherein several tens of units of a hydrocarbon ethylene free from fluorine continues is formed, a dye molecule or a pigment particle in the ink are deposited thereto, so that a water-repellent deterioration occurred. In the alternating copolymer of a fluoroethylene with a hydrocarbon ethylene, a fluoroethylene portion is equally contained on a molecule level within the polymer, a dye molecule having a molecular weight of several hundreds and a dye particle having a primary particle diameter of several hundreds Å cannot be deposited due to the exclusion effect of the site of fluorine. An alternating copolymer of a fluoroethylene with a hydrocarbon ethylene is ideal for the structure of the polymer. However, it is not always necessary that these monomers be alternately bonded, and there exists a portion wherein two or three units of fluoroethylene or hydrocarbon ethylene are continuously bonded. In effect, even though the synthesis of an alternating copolymer is intended, an alternate copolymer having a complete molecular structure is not always formed.

Example C1

The following alternate copolymer of a diperfluoroalkyl fumarate with styrene was dissolved in a fluorocarbon solvent, and the solution was spin-coated on the surface of a nozzle in a nozzle plate comprising a polysulfone resin.

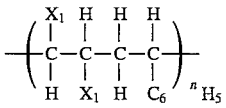

wherein $X_1$ stands for $COOC_mF_{2m+1}$ wherein m is 1 to 20. Although the concentration of the solution and the film thickness can be suitably selected, in this example, a solution having a concentration of 0.3% by weight was coated at 3000 rpm for one min, and the coating was dried at 80° C. to form a 300 Å-thick layer of an alternating polymer of diperfluoroalkyl fumarate with styrene. The observation under a microscope has revealed that the formed thin film was very dense and homogeneous. The film had a contact angle of 105° to water, that is, a high water repellency.

A first substrate of a polysulfone resin and the nozzle plate subjected to a treatment for rendering it water-repellent were washed and dried, and then bonded to each other at 80° C. through a solvent cement of the same polysulfone resin dissolved in a solvent, thereby assembling an ink jet recording head. The appearance of the vicinity of the cross section of the recording head is shown in FIG. 2. Numeral 21 designates a polymer layer of an alternating polymer of diperfluoroalkyl fumarate with styrene formed by coating.

The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in an ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a dye ink. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example C2

An alternating copolymer of ethylene trifluoride chloride with a vinyl ether was dissolved in a fluorinated liquid, and the solution was coated through dipping on the surface of a nozzle in a nozzle plate comprising nickel.

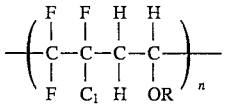

wherein R stands for an alkyl group. The portions unnecessary to be rendered water-repellent were previously masked by taping, resist or the like. Although the concentration of the solution and the film thickness can be suitably selected, in this example, the nozzle plate was pulled up from a solution having a concentration of 0.1% by weight at a rate of 10 cm/min, and the coating was dried at 180° C. to form a 0.1 μm-thick high polymer of an alternating copolymer of ethylene trifluoride chloride with vinyl ether. The observation under a microscope has revealed that the formed thin film was very dense and homogeneous. The film had a contact angle of 110° to water, that is, a high water repellency.

A first substrate of a polycarbonate resin and the nozzle plate subjected to a treatment for rendering it water-repellent and removal of the mask were washed and dried, and bonded to each other with an adhesive, thereby assembling an ink jet recording head. The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in an ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a dye ink. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example C3

An analogue of an alternating copolymer of ethylene tetrafluoride with a vinyl ester was dissolved in a trifluoromethylbenzene, and the solution was coated through dipping on the surface of a nozzle in a nozzle plate comprising a polyethersulfone resin.

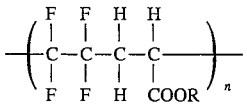

wherein R stands for an alkyl group. The control at the time of the synthesis of the polymer is not complete, and the alternating copolymer contains a portion where two to three units of vinyl ester are continuously bonded. Although the concentration of the solution and the film thickness can be suitably selected, in this example, a solution having a concentration of 1% by weight was coated at 3000 rpm for one min, and the coating was dried at 120° C. to form a 500

Å-thick high polymer layer of an analogue of an alternating copolymer of tetrafluoroethylene with vinyl ester. The observation under a microscope has revealed that the formed thin film was very dense and homogeneous. The film had a contact angle of 100° to water, that is, a high water repellency.

A first substrate of a polyethersulfone resin and the nozzle plate subjected to a treatment for rendering it water-repellent were washed and dried, and then bonded to each other through a solvent for the polyether sulfone resin, thereby assembling an ink jet recording head. The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in an ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a pigment ink. As a result, the contact angle of the recording head to water was 95° or more after rubbing the recording head 5000 times. Thus, an ink jet recording head which gives rise to substantially no deterioration of the water repellency and can provide a high setting quality for a long period of time could be realized.

Reference Example

A random copolymer of vinylidene polyfluoride and a copolymer of ethylene tetrafluoride with vinyl ester was dissolved in a solvent, and the solution was coated on a nozzle plate comprising nickel or a polysulfone resin. The observation under a microscope has revealed that the formed thin film was very dense and homogeneous. The films had a contact angle of 100° or more to water, that is, a high water repellency. The ink jet recording heads were immersed in an ink at 70° C. for 5 days, and the contact angle of the nozzle plates to water was measured again. As a result, the contact angle of the sample where a random copolymer of ethylene tetrafluoride with vinyl ester was coated was reduced to 50° or less. When a treatment for wiping off the ink was separately conducted, the water-repellency was recovered, which suggested a deterioration of the water repellency attributable to a partial deposition of a dye molecule or a pigment particle in the ink. Further, a rubbing test was conducted through the use of a silicone rubber while injecting a dye ink. As a result, the contact angle of the sample to water was lowered to 60° or less when the head was rubbed 2000 times with the silicone rubber. Although a treatment for rubbing off the ink was separately conducted, the water repellency was recovered, which suggested that the high polymer layer was peeled off.

The present invention was described above with reference to examples. Materials used in the ink jet recording head and structures of the ink jet recording head and the kind of the fluoropolymer layer formed on the surface of the nozzle may be varied and are not particularly limited. Examples of the fluoroethylene include ethylene tetrafluoride, ethylene trifluoride chloride, propylene hexafluoride, perfluorovinyl ether, perfluorovinyl ester and diperfluoroalkyl fumarate. Examples of the hydrocarbon ethylene include vinyl alcohol, vinyl ether, vinyl ester, vinyl chloride, styrene, dialkyl fumarate and methyl methacrylate. Further, there is no particular limitation on the solvent for the fluoropolymer and coating method.

Embodiment D

In the present embodiment, the process for producing an ink jet recording head having a fluoropolymer layer formed on the surface of a nozzle for jetting an ink comprises the steps of:

a) preparing a solution of a fluoropolymer dissolved in a solvent;

b) coating said fluoropolymer on the whole surface of a nozzle plate by dipping;

c) grinding the reverse surface of the nozzle plate to remove at least the fluoropolymer layer; and d) bonding the nozzle plate to an ink jet recording head.

In the treatment for rendering the surface of the nozzle water-repellent, since the contact angle of water to the surface of the nozzle should be at least 90°, preferably at least 100°, the polarizability is so small that it is indispensable to introduce fluorine having a remarkably small intermolecular cohesive force. Further, in the treatment for rendering the surface of the nozzle water-repellent, a high adhesion is separately required from the viewpoint of practical use.

The fluoropolymer represented by polyethylene tetrafluoride has excellent features such as heat resistance, chemical resistance and weather resistance. It, however, is insoluble in a solvent, so that, as described above, only powder coating can be applied thereto. Therefore, not only the film strength is low, but also the adhesion at the interface is remarkably low. In recent years, a copolymer of a solvent-soluble polymer with a fluoropolymer and a synthetic polymer having a special fluorine-containing side chain have become prepared. Since these polymers can maintain properties of the conventional fluoropolymers and are soluble in a solvent, a smooth surface free from a pinhole can be easily prepared by coating. In order to attain a film strength and a bonding strength between the film and the substrate derived from the film strength, it is indispensable for the molecular weight to be increased prior to the formation of the film.

In order to form a fluoropolymer layer also within a nozzle, it is necessary that after a fluoropolymer is dissolved in a solvent having a suitable vapor pressure to a relative low concentration, the solution be coated on a nozzle plate isolated as a part through dipping. Further, the nozzle plate cannot be bonded to an ink jet recording head without removing through grinding the fluoropolymer layer formed on the reverse surface of the nozzle plate. Further, when the reverse surface of the nozzle plate serves as an ink passage, the presence of the fluoropolymer polymer is detrimental to the discharge of bubbles formed within the ink and it becomes impossible to conduct a treatment for rendering the surface hydrophilic for preventing a lowering in the capability of discharging bubbles.

Example D1

FIG. 1 is a typical cross-sectional view of an embodiment of an ink jet recording head. Numeral 1 designates a pressure chamber which is a portion for obtaining a pressure used in the ejection of an ink by means of a PZT element or a heating element. Numeral 2 designates an ink jet nozzle. Numeral 3 designates a first substrate provided with a pattern groove for an ink passage. Numeral 4 designates a nozzle plate. An ink passage is formed by laminating both members on top of the other.

FIG. 3 is a typical cross-sectional view showing the step of treatment for rendering the surface of a nozzle water-repellent wherein FIG. 3(*a*) is an enlarged view of the vicinity of the nozzle in a nozzle plate comprising a polysulfone resin prior to the treatment and FIG. 3(*b*) shows a state obtained when "Teflon AF" (manufactured by De Pont (E. I.) de Nemours & Co) is dissolved in a fluorocarbon solvent having a suitable vapor pressure and coated on the whole surface of a nozzle plate comprising a polysulfone resin through dipping. Although the concentration of the solution and the film thickness can be suitably selected, in this example, the nozzle plate was pulled up from a solution having a concentration of 1 by weight at a rate of 10 cm/min, and the coating was dried at 120° C. to form a 0.1 μm-thick polymer layer of "Teflon AF". The observation under a microscope has revealed that the formed thin film was very dense and homogeneous. The film had a contact angle of 110° to water, that is, a high water repellency. Further, it was confirmed that the treatment for rendering the inside of the nozzle ink-repellent could be homogeneously conducted.

FIG. 3(*c*) shows a state obtained when the reverse surface of the nozzle plate was ground through the use of a lapping paper. Suitable grinding conditions may be selected. In this example, the grinding was conducted by a method wherein use is made of a lapping paper of #8000 comprising a diamond powder as a grinding agent, a load of 20 g/cm$^2$ is applied while injecting water, and the surface of the fluoropolymer and the lapping paper are mutually rotated. Since the control of the flatness of the surface is relatively easy, no fluoropolymer layer within the nozzle is removed and the water repellency of the surface of the nozzle is maintained. In the polysulfone resin per se as well, the slightly ground surface 22 is a flat surface having a suitable surface roughness and has an improved wettability with an ink. If necessary, it is also possible to conduct a treatment for rendering the surface hydrophilic. The nozzle plate subjected to a treatment for rendering the surface water-repellent and a first plate comprising a polysulfone resin were washed and dried, and a solvent was coated thereon. The nozzle plate and the first substrate were subjected to pressure bonding at temperature of 80° C. to assemble an ink jet recording head. The reverse surface of the nozzle plate had an excellent flatness, a good working property and a large adhesion.

The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in a dye ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a dye ink. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example D2

FIG. 4 is a typical cross-sectional view of an embodiment of an ink jet recording head. Numeral 1 designates a pressure chamber which is a portion for obtaining a pressure used in the ejection of an ink by means of a PZT element or a heating element. Numeral 2 designates an ink jet nozzle. Numeral 31 designates a first substrate provided with a pattern groove for an ink passage. Numeral 32 designates a second substrate. An ink passage is formed by laminating both members on top of the other. Numeral 33 designates a nozzle plate.

FIG. 5 is a typical cross-sectional view showing the step of a treatment for rendering the surface of a nozzle water-repellent. FIG. 5(*a*) is an enlarged view of the vicinity of a nozzle in a nozzle plate comprising nickel prior to the treatment. FIG. 5(*b*) shows a state obtained when "CYTOP" (manufactured by Asahi Glass Co., Ltd.) is dissolved in a fluorocarbon solvent having a suitable vapor pressure and coated on the whole surface of a nozzle plate comprising nickel through dipping. Although the concentration of the solution and the film thickness can be suitably selected, in this example, the nozzle plate was pulled up from a solution having a concentration of 3% by weight at a rate of 3 cm/min, and the coating was dried at 180° C. to form a 0.1 μm-thick polymer layer of "CYTOP CTX". The observation under a microscope has revealed that the formed thin film was very dense and homogeneous. The film had a high contact angle of 105° to water, that is, a high water repellency. Further, it was also confirmed that the treatment for rendering the inside of the nozzle ink-repellent could be homogeneously conducted.

FIG. 5(*c*) shows a state obtained when the reverse surface of the nozzle plate was ground through the use of a lapping paper. Suitable grinding conditions may be selected. In this example, the grinding was conducted by a method wherein use is made of a lapping paper of #2000 comprising a diamond powder as a grinding agent, a load of 100 g/cm$^2$ is applied while injecting water, and the surface of the fluoropolymer and the lapping paper are mutually rotated. Since the control of the flatness of the surface is relatively easy, no fluoropolymer layer within the nozzle is removed and the water repellency of the surface of the nozzle is maintained. In the polysulfone resin per se as well, the slightly ground surface 22 is a flat surface having a suitable surface roughness and has an improved adhesion to an adhesive. FIG. 5(*d*) shows a state obtained when the nozzle plate subjected to the above-described treatment for rendering the surface water-repellent and a first substrate comprising a polycarbonate resin are washed, dried and then bonded to each other with an adhesive. It is apparent that a satisfactory bonding strength is obtained.

The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in a dye ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a dye ink. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example D3

A high polymer of an ethylene tetrafluoride/vinyl ester copolymer was dissolved in a solvent having a suitable vapor pressure, and the solution was coated through dipping on a nozzle plate comprising a polyethersulfone resin. Although the concentration of the solution and the film thickness can be suitably selected, in this example, the nozzle plate was pulled up from a solution having a concentration of 0.1% by weight at a rate of 20 cm/min, and the coating was dried at 120° C. to form a 0.05 μm-thick fluoropolymer layer. The observation under a microscope has revealed that the formed thin film was very dense and homogeneous. The film had a contact angle of 100° to water, that is, a high water repellency. Further, it was confirmed that the treatment for rendering the inside of the nozzle ink-repellent could be homogeneously conducted. Grinding was conducted through the use of a PVA (polyvinyl alcohol) grinding stone under suitable conditions to remove a fluoropolymer polymer formed on the reverse surface of the nozzle plate.

A first substrate comprising a polycarbonate sulfone resin and the nozzle plate subjected to a surface treatment were washed and dried, and then bonded to each other through the use of a solvent comprising a polyethersulfone resin to assemble an ink jet recording head. The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in a pigment ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a dye ink. As a result, the contact angle of the recording head to water was 95° or more after rubbing the recording head 5000 times. Thus, an ink jet recording head which gives rise to substantially no deterioration of the water repellency and can provide a high setting quality for a long period of time could be realized.

The present invention was described above with reference to examples. Materials used in the ink jet recording head and structures of the ink jet recording head and the kind of the fluoropolymer layer formed on the surface of the nozzle may be varied and are not particularly limited. Further, there is no particular limitation on the solvent for the fluoropolymer and the conditions for coating and grinding.

As described above, the present invention can provide an ink jet recording head capable of providing a high setting quality through a homogeneous treatment for rendering the surface and inside of the nozzle water-repellent. Further, the treatment for rendering a recording head water-repellent according to the present invention is very excellent in the persistence of the water repellency, which contributes to a prolongation of the service life of the recording head.

Embodiment E

According to this embodiment, the process for producing an ink jet recording head having a fluoropolymer layer formed on the surface of a nozzle for jetting an ink comprises the steps of:

a) coating a positive-working resist on at least the reverse surface of a nozzle plate;

b) irradiating the nozzle plate with an ionizing radiation from the surface side of the nozzle plate with the reverse surface side being light-shielded;

c) developing the irradiated surface and removing the resist from the surface of the nozzle plate and the inside of the nozzle;

d) coating a solution of a fluoropolymer dissolved in a solvent on the whole surface of the nozzle plate by dipping;

e) removing the resist layer and the fluoropolymer layer on the reverse surface side of the nozzle plate by means of a resist peeling solution; and f) bonding the nozzle plate to an ink jet recording head.

In the treatment for rendering the surface of the nozzle water-repellent, since the contact angle of water to the surface of the nozzle should be at least 90°, preferably at least 100°, the polarizability is so small that it is indispensable to introduce fluorine having a remarkably small intermolecular cohesive force. Further, in the treatment for rendering the surface of the nozzle water-repellent, a high adhesion is separately required from the viewpoint of use.

The fluoropolymer represented by polyethylene tetrafluoride has excellent features such as heat resistance, chemical resistance and weather resistance. It, however, is insoluble in a solvent, so that, as described above, only powder coating can be applied thereto. Therefore, not only the film strength is low, but also the adhesion at the interface is remarkably low. In recent years, a copolymer of a solvent-soluble polymer with a fluoropolymer and a synthetic polymer having a special fluorine-containing side chain have become prepared. Since these materials can substantially maintain properties of the conventional fluoropolymers and are soluble in a solvent, it is possible to easily obtain a smooth surface free from a pinhole through coating. In order to attain a film strength and a bonding strength between the film and the substrate derived from the film strength, it is indispensable for the molecular weight to be increased prior to the formation of the film.

In order to homogeneously form a fluoropolymer layer also within a nozzle, it is necessary that after a fluoropolymer is dissolved in a solvent having a suitable vapor pressure to a relative low concentration, the solution be coated on a nozzle plate isolated as a part through dipping. Further, the nozzle plate cannot be bonded to an ink jet recording head without removing through grinding the fluoropolymer layer formed on the reverse surface of the nozzle plate. Further, when the reverse surface of the nozzle plate serves as an ink passage, the presence of the fluoropolymer polymer is detrimental to the discharge of bubbles formed within the ink and it becomes impossible to conduct a treatment for rendering the,surface hydrophilic for preventing a lowering in the capability of discharging bubbles.

The above object can be attained by forming a resist only on the reverse surface of the nozzle plate and removing the fluoropolymer layer together with the resist layer through the use of a resist peeling solution. The resist is usually patterned by exposure through a photomask. This method is disadvantageous in that the alignment is troublesome, which is causative of a lowering in the yield. When use is made of an exposure method which comprises coating a positive-working resist on at least the reverse surface of the nozzle plate, light-shielding the reverse surface of the plate and irradiating the nozzle plate from the surface thereof, patterning is automatically conducted and it becomes unnecessary to use the photomask.

Example E1

FIG. 1 is a typical cross-sectional view of an embodiment of an ink jet recording head. Numeral 1 designates a pressure chamber which is a portion for obtaining a pressure used in the ejection of an ink by means of a PZT element or a heating element. Numeral 2 designates an ink jet nozzle.

Numeral 3 designates a first substrate provided with a pattern groove for an ink passage. Numeral 4 designates a nozzle plate. An ink passage is formed by laminating both members on top of the other.

FIG. 6 is a typical cross-sectional view showing the step of a treatment for rendering the surface of a nozzle water-repellent. FIG. 6(*a*) is an enlarged view of the vicinity of the nozzle in a nozzle plate comprising a polysulfone resin prior to the treatment. FIG. 6(*b*) shows a state obtained when the reverse surface of the nozzle plate and the inside of the nozzle is spin-coated with a positive-working resist which is then prebaked to form a resist layer 11. FIG. 6(*c*) shows the step of irradiating the nozzle plate from the surface of the nozzle plate with the reverse surface being light-shielded by means of a light-shielding film 12 with a light from a mercury lamp. It is a matter of course that the nozzle plate may be sandwiched between two sheets of glass sheets. FIG. 6(*d*) shows a state obtained when the exposed nozzle plate is developed, sufficiently rinsed and post-baked to leave the resist layer only on the reverse surface of the nozzle plate.

FIG. 6(*e*) shows a state obtained when "Teflon AF" (manufactured by De Pont (E. I.) de Nemours & Co) is dissolved in a fluorocarbon solvent having a suitable vapor pressure and coated through dipping on the whole surface of a nozzle plate comprising a polysulfone resin. Although the concentration of the solution and the film thickness can be suitably selected, in this example, the nozzle plate was pulled up from a solution having a concentration of 1% by weight at a rate of 10 cm/min, and the coating was dried at 120° C. to form a 0.1 μm-thick polymer layer of "Teflon AF". The observation under a microscope has revealed that the formed thin film was very dense and homogeneous. The film had a contact angle of 110° to water, that is, a high water repellency. Further, it was confirmed that the treatment for rendering the inside of the nozzle ink-repellent could be homogeneously conducted. FIG. 6(*f*) shows a state obtained when the resist layer and fluoropolymer layer on the reverse surface of the nozzle plate are removed through the use of a resist peeling solution.

The fluoropolymer layer in the inside of the nozzle and on the surface of the nozzle plate were not removed, and the effect of the treatment for rendering the in the inside of the nozzle and on the surface of the nozzle plate water-repellent was maintained. A polysulfone resin was exposed on the reverse surface of the nozzle place. If necessary, it is also possible to conduct a treatment for rendering the surface hydrophilic. The nozzle plate subjected to a treatment for rendering the surface water-repellent and a first plate comprising a polysulfone resin were washed and dried, and a solvent was coated thereon. The nozzle plate and the first substrate were bonded to each other through a solvent cement to assemble an ink jet recording head. The reverse surface of the nozzle plate had a good adhesion because it had not been subjected to the treatment for rendering the surface water-repellent.

The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in a dye ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a dye ink. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example E2

FIG. 4 is a typical cross-sectional view of an embodiment of an ink jet recording head. Numeral 1 designates a pressure chamber which is a portion for obtaining a pressure used in the ejection of an ink by means of a PZT element or a heating element. Numeral 2 designates an ink jet nozzle. Numeral 31 designates a first substrate provided with a pattern groove for an ink passage. Numeral 32 designates a second substrate. An ink passage is formed by laminating both members on top of the other. Numeral 33 designates a nozzle plate.

FIG. 7 is a typical cross-sectional view showing the step of a treatment for rendering the surface of a nozzle water-repellent. FIG. 7(*a*) is an enlarged view of the vicinity of a nozzle in a nozzle plate comprising nickel prior to the treatment. FIG. 7(*b*) shows a state obtained when a positive-working resist is formed through dip coating on the whole surface of a nozzle including the inside of the nozzle and prebaked to form a resist layer 11. FIG. 7(*c*) shows the step of irradiating the nozzle plate from the surface with the reverse surface being light-shielded by means of a metal plate 12 with a light from a mercury lamp. FIG. 7(*d*) shows a state obtained when the exposed nozzle plate is developed with a developing solution, sufficiently rinsed and post-baked to leave the resist layer only on the reverse surface of the nozzle plate.

FIG. 7(*e*) shows a state obtained when "CYTOP" (manufactured Asahi Glass Co., Ltd.) is dissolved in a fluorocarbon solvent having a suitable vapor pressure and coated on the whole surface of a nozzle plate comprising nickel through dipping. Although the concentration of the solution and the film thickness can be suitably selected, in this example, the nozzle plate was pulled up from a solution having a concentration of 0.2% by weight at a rate of 100 cm/min, and the coating was dried at 120° C. to form a 0.05 μm-thick polymer layer of "CYTOP CTX". The observation under a microscope has revealed that the formed thin film was very dense and homogeneous. The film had a contact angle of 105° to water, that is, a high water repellency. Further, it was confirmed that the treatment for rendering the inside of the nozzle ink-repellent could be homogeneously conducted. FIG. 7(*f*) shows a state obtained when after the resist layer and fluoropolymer layer on the reverse surface of the nozzle plate are removed through the use of a resist peeling solution, the nozzle plate and a first substrate comprising a polycarbonate resin are washed and dried and then bonded to each other with an adhesive. A satisfactory bonding strength could be obtained.

The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in a dye ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a dye ink.

As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example E3

A resist layer was left only on the reverse surface of a nozzle plate comprising a stainless steel in the same manner as that of Example E2. A high polymer of an ethylene tetrafluoride/vinyl ester copolymer was dissolved in a solvent having a suitable vapor pressure, and the solution was coated on the nozzle plate through dipping. Although the concentration of the solution and the film thickness can be suitably selected, in this example, the nozzle plate was pulled up from a solution having a concentration of 0.1% by weight at a rate of 20 cm/min, and the coating was dried at 120° C. to form a 0.02 μm-thick fluoropolymer layer. The observation under a microscope has revealed that the formed thin film was very dense and homogeneous. The film had a high contact angle of 100° to water, that is, a high water repellency. Further, it was also confirmed that the treatment for rendering the,inside of the nozzle ink-repellent could be homogeneously conducted. Further, the resist layer and fluoropolymer layer on the reverse surface of the nozzle plate were removed with a resist peeling solution.

A first substrate comprising a polyethersulfone resin and the nozzle plate subjected to the surface treatment were washed and dried and then bonded to each other by means of an adhesive tape. The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in a pigment ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a pigment ink. As a result, the contact angle of the recording head to water was 95° or more after rubbing the recording head 5000 times. Thus, an ink jet recording head which gives rise to substantially no deterioration of the water repellency and can provide a high setting quality for a long period of time could be realized.

The present invention was described above with reference to examples. Materials used in the ink jet recording head and structures of the ink jet recording head and the kind of the fluoropolymer layer and the positive-working layer may be varied and are not particularly limited. Further, there is no particular limitation on the solvent for the fluoropolymer and the coating method.

Embodiment F

In the process according to the present embodiment, an ink jet recording head comprising a fluoropolymer layer formed on the surface of a nozzle for jetting an ink is produced by coating a fluoropolymer on the whole surface of a nozzle plate through dipping, forming a protective layer at least within the nozzle, grinding the reverse surface of the nozzle plate to remove at least the fluoropolymer layer and removing the protective layer.

In the treatment for rendering the surface of the nozzle water-repellent, since the contact angle of water to the surface of the nozzle should be at least 90°, preferably at least 100°, the polarizability is so small that it is indispensable to introduce fluorine having a remarkably small intermolecular cohesive force. Further, in the treatment for rendering the surface of the nozzle water-repellent, a high adhesion is separately required from the viewpoint of use.

The fluoropolymer represented by polyethylene tetrafluoride has excellent features such as heat resistance, chemical resistance and weather resistance. It, however, is insoluble in a solvent, so that, as described above, only powder coating can be applied thereto. Therefore, not only the film strength is low, but also the adhesion at the interface is remarkably low. In recent years, a copolymer of a solvent-soluble polymer with a fluoropolymer and a synthetic polymer having a special fluorine-containing side chain have become prepared. Since these polymers can maintain properties of the conventional fluoropolymers and are soluble in a solvent, a smooth surface free from a pinhole can be easily prepared by coating. In order to attain a film strength and a bonding strength between the film and the substrate derived from the film strength, it is indispensable for the molecular weight to be increased prior to the formation of the film.

In order to homogeneously form a fluoropolymer layer also within a nozzle, it is necessary that after a fluoropolymer is dissolved in a solvent having a suitable vapor pressure to a relative low concentration, the solution be coated on a nozzle plate isolated as a part through dipping. Further, the nozzle plate cannot be bonded to an ink jet recording head without removing through grinding the fluoropolymer layer formed on the reverse surface of the nozzle plate. Further, when the reverse surface of the nozzle plate serves as an ink passage, the presence of the fluoropolymer polymer is detrimental to the discharge of bubbles formed within the ink and it becomes impossible to conduct a treatment for rendering the surface hydrophilic for preventing a lowering in the capability of discharging bubbles.

in this connection, it is noted that, in the step of grinding, when the fluoropolymer layer is not protected, the fluoropolymer layer is flawed by an abrasive material or a fraction of the ground substrate, so that an ink droplet does not go straight, which unfavorably gives rise to an unacceptable setting quality. It is preferred for the protective layer to be formed on the surface of the nozzle and within the nozzle. However, it is very difficult to form another layer on a fluoropolymer layer having excellent water repellency and oil repellency according to a simple method. Since the nozzle comprises a thin pipe, a protective layer can be relatively easily formed within the nozzle. In the step of grinding, the protection of the surface of the nozzle is not always necessary when the surface of the nozzle is in close contact with a support and a protective layer is formed within the nozzle. When the protective layer comprises a high polymer soluble in a solvent which does not attack the fluoropolymer, it can be easily provided or removed and the water repellency of the fluoropolymer as well can be maintained.

Example F1

FIG. 1 is a typical cross-sectional view of an embodiment of an ink jet recording head. Numeral 1 designates a pressure chamber which is a portion for obtaining a pressure used in the ejection of an ink by means of a PZT element or a heating element. Numeral 2 designates an ink jet nozzle.

Numeral 3 designates a first substrate provided with a pattern groove for an ink passage. Numeral 4 designates a nozzle plate. An ink passage is formed by laminating both members on top of the other.

FIG. 8 is a typical cross-sectional view showing the step of treatment for rendering the surface of a nozzle water-repellent. FIG. 8(*a*) is an enlarged view of the vicinity of the nozzle in a nozzle plate comprising a polysulfone resin prior to the treatment. FIG. 8(*b*) shows a state obtained when "Teflon AF" (manufactured by De Pont (E. I.) de Nemours & Co) is dissolved in a fluorocarbon solvent having a suitable vapor pressure and coated on the whole surface of a nozzle plate comprising a polysulfone resin through dipping. Although the concentration of the solution and the film thickness can be suitably selected, in this example, the nozzle plate was pulled up from a solution having a concentration of 1 by weight at a rate of 10 cm/min, and the coating was dried at 120° C. to form a 0.1 μm-thick polymer layer of "Teflon AF". The observation under a microscope has revealed that the formed thin film was very dense and homogeneous. The film had a contact angle of 110° to water, that is, a high water repellency. Further, it was confirmed that the treatment for rendering the inside of the nozzle ink-repellent could be homogeneously conducted.

FIG. 8(*c*) shows a state obtained when a photoresist having a high viscosity is coated through dipping and baked without exposure. Although no homogeneous coating could be conducted, a protective layer 13 was formed at least within the nozzle. The polysulfone resin, as such, is attacked by a solvent for a photoresist. Since, however, a dense film comprising a fluoropolymer is formed, no deterioration occurred. FIG. 8(*d*) shows a state obtained when the reverse surface of the nozzle plate is ground through the use of a lapping paper. Suitable grinding conditions may be selected. In this example, the grinding was conducted by a method wherein use is made of a lapping paper of #8000 comprising a diamond powder as a grinding agent, a load of 20 g/cm$^2$ is applied while injecting water, and the surface of the fluoropolymer and the lapping paper are mutually rotated. The fluoropolymer layer and protective layer within the nozzle were not ground but maintained as they were. In the polysulfone resin per se as well, the slightly ground surface 14 is a flat surface having a suitable surface roughness and has an improved wettability with an ink. If necessary, it is also possible to conduct a treatment for rendering the surface hydrophilic. FIG. 8(*e*) shows a state obtained when the nozzle plate is immersed in a water-based resist peeling solution and heated to remove the resist of the protective layer. A smooth fluoropolymer layer free from a flaw caused by grinding appeared on the surface of the nozzle.

The nozzle plate subjected to a treatment for rendering the surface water-repellent and a first plate comprising a polysulfone resin were washed and dried, and a solvent was coated thereon. The nozzle plate and the first substrate were bonded to each other through a solvent cement to assemble an ink jet recording head. The reverse surface of the nozzle plate had an excellent flatness, a good working property and a large adhesion.

The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in a dye ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a dye ink. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example F2

FIG. 9 is a typical cross-sectional view of an embodiment of an ink jet recording head. FIG. 9(*a*) is an enlarged view of the vicinity of the nozzle in a nozzle plate comprising nickel prior to the treatment. FIG. 9(*b*) shows a state obtained when "CYTOP" (manufactured by Asahi Glass Co., Ltd.) is dissolved in a fluorocarbon solvent having a suitable vapor pressure and coated on the whole surface of a nozzle plate comprising nickel through dipping. Although the concentration of the solution and the film thickness can be suitably selected, in this example, the nozzle plate was pulled up from a solution having a concentration of 0.2% by weight at a rate of 100 cm/min, and the coating was dried at 120° C. to form a 0.05 μm-thick polymer layer of "CYTOP CTX". The observation under a microscope has revealed that the formed thin film was very dense and homogeneous. The film had a high contact angle of 105° to water, that is, a high water repellency. Further, it was also confirmed that the treatment for rendering the inside of the nozzle ink-repellent could be homogeneously conducted.

FIG. 9(*c*) shows a state obtained when an acrylic resin is dissolved in acetone and the solution is coated several times through dipping to form a coating which is then dried. Although no homogeneous coating could be attained, a protective layer 13 was formed at least within the nozzle. FIG. 9(*d*) shows a state obtained when the reverse surface of the nozzle plate is ground through the use of a lapping paper. Suitable grinding conditions may be selected. In this example, the grinding was conducted by a method wherein use is made of a lapping paper of #2000 comprising a diamond powder as a grinding agent, a load of 100 g/cm$^2$ is applied while injecting water, and the surface of the fluoropolymer and the lapping paper are mutually rotated. The fluoropolymer layer and protective layer within the nozzle could be maintained as they were without being ground. In the nickel per se as well, the slightly ground surface 14 is a flat surface having a suitable surface roughness and has an improved adhesion to an adhesive. If necessary, it is also possible to conduct a treatment for rendering the surface hydrophilic. FIG. 9(*e*) shows a state obtained when the nozzle plate is exposed to an ultrasonic wave and the acrylic resin as the protective layer is removed. A smooth fluoropolymer layer free from a flaw caused by grinding appeared on the surface of the nozzle.

FIG. 9(*f*) shows a state obtained when the nozzle plate subjected to the above-described treatment and a first substrate comprising a polycarbonate resin washed and dried and then bonded to each other with an adhesive. A satisfactory bonding strength is obtained.

The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in a dye ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while, injecting a dye ink. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example F3

A high polymer of an ethylene tetrafluoride/vinyl ester copolymer was dissolved in a solvent having a suitable vapor pressure, and the solution was coated on a nozzle plate comprising stainless steel through dipping. Although the concentration of the solution and the film thickness can be suitably selected, in this example, the nozzle plate was pulled up from a solution having a concentration of 0.1% by weight at a rate of 20 cm/min, and the coating was dried at 120° C. to form a 0.02 μm-thick fluoropolymer layer. The observation under a microscope has revealed that the formed thin film was very dense and homogeneous. The film had a high contact angle of 100° to water, that is, a high water repellency. Further, it was also confirmed that the treatment for rendering the inside of the nozzle ink-repellent could be homogeneously conducted.

PVA (polyvinyl alcohol) was dissolved in dioxane, and the coating was conducted. The resultant coating was then dried to form a protective layer at least within the nozzle. Further, grinding was conducted through the use of a PVA grinding stone under suitable conditions to remove a fluoropolymer polymer formed on the reverse surface of the nozzle plate. The nozzle plate was immersed in dioxane and, in this state, exposed to an ultrasonic wave to remove the protective layer comprising PVA.

A first substrate comprising a polyethersulfone resin and the nozzle plate subjected to the above-described surface treatment were washed and dried and then bonded to each other by means of an adhesive tape in the same manner as that of Example 2 to assemble an ink jet recording head. The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in a pigment ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a pigment ink. As a result, the contact angle of the recording head to water was 95° or more after rubbing the recording head 5000 times. Thus, an ink jet recording head which gives rise to substantially no deterioration of the water repellency and can provide a high setting quality for a long period of time could be realized.

The present invention was described above with reference to examples. Materials used in the ink jet recording head and structures of the ink jet recording head and the kind of the fluoropolymer layer and protective layer formed on the surface of the nozzle may be varied and are not particularly limited. Further, there is no particular limitation on the solvent for the fluoropolymer and the conditions for coating and grinding.

Embodiment G

In the process according to this embodiment, an ink jet recording head comprising a fluoropolymer layer formed on the surface of a nozzle for jetting an ink is produced by spreading a solution of a fluoropolymer dissolved in a solvent on the surface of water, evaporating the solvent and bringing the spread film into contact with the surface of a nozzle.

In the treatment for rendering the surface of the nozzle water-repellent, since the contact angle of water to the surface of the nozzle should be at least 90°, preferably at least 100°, the polarizability is so small that it is indispensable to introduce fluorine having a remarkably small intermolecular cohesive force. Further, in the treatment for rendering the surface of the nozzle water-repellent, a high adhesion is separately required from the viewpoint of use.

The fluoropolymer represented by polyethylene tetrafluoride has excellent features such as heat resistance, chemical resistance and weather resistance. It, however, is insoluble in a solvent, so that, as described above, only powder coating can be applied thereto. Therefore, not only the film strength is low, but also the adhesion at the interface is remarkably low. In recent years, a copolymer of a solvent-soluble polymer with a fluoropolymer and a synthetic polymer having a special fluorine-containing side chain have become prepared. Since these polymers can maintain properties of the conventional fluoropolymers and are soluble in a solvent, a smooth surface free from a pinhole can be easily prepared by coating. In order to attain a film strength and a bonding strength between the film and the substrate derived from the film strength, it is indispensable for the molecular weight to be increased prior to the formation of the film.

When a solution of a fluoropolymer dissolved in a solvent is spread on the surface of water and the solvent is then evaporated, a water surface spread film of a fluoropolymer is formed. The film thickness can be regulated by preparing a calibration curve and regulating the amount of dropping of the solution, the concentration of the solution, etc. When the surface of a nozzle is brought into contact with the surface of water, the water surface spread film of a fluoropolymer is transferred to only a portion which has been brought into contact with the spread film but not transferred within the nozzle. Even in a failure in operation, the inner diameter of the nozzle is merely reduced by the film thickness of the water surface spread film, so that the water surface spread film enters the inside of the nozzle by the same distance as the inner diameter of the nozzle at the maximum. Ink repellency can be attained even when the thickness of the fluoropolymer film is as small as about 100 Å. Since the nozzle diameter is 100 μm or less, there occurs no problem in the practical use.

The water surface spread film of a fluoropolymer has a sufficient film strength. A sufficient film strength can be obtained by transferring a water surface spread film of a fluoropolymer on the surface of a nozzle and heat-treating the transferred film. If necessary, the transfer of the water surface spread film of a fluoropolymer on the surface of the nozzle can be repeated a plurality of times for the purpose of enhancing the ink repellency.

Example G1

FIG. 10 is a schematic view of an ink jet recording head. Numeral 101 designates a pressure chamber which is a portion for obtaining a pressure used in the ejection of an ink by means of a PZT element or a heating element. Numeral 102 designates an ink passage, and numeral 103 designates an ink jet nozzle.

FIG. 11 is a typical cross-sectional view showing the step of treatment for rendering the surface of a nozzle water-repellent. FIG. 11(*a*) shows a state obtained when "Teflon AF" (manufactured by De Pont (E. I.) de Nemours & Co) is dissolved in a fluorocarbon solvent and the solution is spread 123 on the surface of water 122 contained in a vessel 121. Although the concentration of the solution and the amount of dropping of the solution can be suitably selected, in this example, a solution having a concentration of 0.05% by weight was,prepared, the amount of solution capable of forming a 0.1 μm-thick polymer layer of "Teflon AF" was calculated, and the solution in the determined amount was dropped on the surface of water. FIG. 11(*b*) shows a state obtained when the surface of a nozzle of ink jet recording head 125 comprising an acrylic resin is brought into contact with the water surface spread Langmuir film 124 of a fluoropolymer formed by evaporating the fluorocarbon solvent. It is not always necessary that the surface of the nozzle be brought into contact with the surface of water in a parallel manner, and the surface of the nozzle may be brought into contact with the surface of water in a slightly inclined state. Further, the nozzle may be submerged into the water to some extent. FIG. 11(*c*) shows a state obtained when a nozzle is pulled up from the surface of water to transfer a water surface spread film of a fluoropolymer to the surface of the nozzle.

FIG. 12 is an enlarged view of the nozzle portion of ink jet recording head 125 for jetting an ink shown in FIG. 11(*c*). When the surface of the nozzle was brought into contact with the surface of water 122, the water surface spread film 124 of a fluoropolymer was transferred to the surface of the nozzle 103 only at a portion which had been brought into contact with the water surface spread film and the water surface spread film positioned at the hole of the nozzle was left as it was on the surface of water. The transferred film was heat-treated at 150° C. for one hour, and then observed under a microscope. As a result, it was confirmed that the formed thin film was very dense and homogeneous. The film had a contact angle of 100° to water, that is, a high water repellency. Further, it was confirmed that the ink passage 102 inside of the nozzle was subjected to no treatment for rendering it water-repellent.

The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in a dye ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a dye ink. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example G2

FIG. 4 is a typical cross-sectional view of an embodiment of an ink jet recording head. Numeral 1 designates a pressure chamber which is a portion for obtaining a pressure used in the ejection of an ink by means of a PZT element or a heating element. Numeral 3 designates an ink jet nozzle. Numeral 31 designates a first substrate provided with a pattern groove for an ink passage. Numeral 32 designates a second substrate. An ink passage is formed by laminating both members on top of the other. Numeral 33 designates a nozzle plate. FIG. 13 is a typical cross-sectional views showing the steps of rendering the surface of a nozzle water-repellent. FIG. 13(*a*) is an enlarged view of the vicinity of a nozzle in a nozzle plate 43 comprising nickel prior to the treatment. FIG. 13(*b*) is shows a state obtained when "CYTOP" (manufactured by Asahi Glass Co., Ltd.) is dissolved in a fluorocarbon solvent, the solution is spread on the surface of water, a 0.05 μm-thick water surface spread film 31 of a fluoropolymer formed on the surface of water is transferred on the surface of a nozzle plate and the transferred film is heat-treated at 180° C. for one hour. The observation of the thin film, under a microscope has revealed that the formed thin film was very dense and homogeneous. The film had a contact angle of 108° C. to water, that is, a high water repellency. Further, it was confirmed that the inside of the nozzle was subjected to no treatment for rendering it water-repellent. FIG. 13(*c*) shows a state obtained when the nozzle plate subjected to the above-described surface treatment for rendering the surface of the nozzle water-repellent and a first substrate 52 comprising a polycarbonate resin are washed and dried and then bonded to each other with an adhesive 51.

The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in a dye ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a dye ink. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example G3

A high polymer of a diperfluoroalkyl fumarate/dialkyl fumarate copolymer was dissolved in a fluorocarbon solvent, and the solution was spread on the surface of water. The resultant water spread film of a fluoropolymer having a thickness of 0.01 μm was transferred on the surface of a nozzle in the same manner as that of Example 1. The above step of transfer was additionally repeated twice, and the resultant film was heat-treated at 120° C. for one hour. The observation of the thin film under a microscope has revealed that the formed thin film was very dense and homogeneous. The film had a contact angle of 105° to water, that is, a high water repellency. Further, it was confirmed that the inside of the nozzle was subjected to substantially no treatment for rendering it water-repellent.

The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in a pigment ink at 70° C. for 5 days, and a setting test was conducted in the same manner as that described above. The setting quality was the same as the initial property. That is, the recording head maintained a sufficient ink repellency.

A rubbing test was conducted through the use of a silicone rubber while injecting a pigment ink. As a result, the contact angle of the recording head to water was 95° or more after rubbing the recording head 5000 times. Thus, an ink jet recording head which gives rise to substantially no deterioration of the water repellency and can provide a high setting quality for a long period of time could be realized.

The present invention was described above with reference to examples. Materials used in the ink jet recording head and structures of the ink jet recording head and the kind of the fluoropolymer layer formed on the surface of the nozzle may be varied and are not particularly limited.

Embodiment H

In the present embodiment, a Langmuir Blodgett film of a fluoropolymer is formed on the surface of a nozzle for jetting an ink. The Langmuir Blodgett film is formed through the use of a polydiperfluoroalkyl fumarate or its copolymer as a fluoropolymer.

In the process according to the present embodiment, a Langmuir Blodgett film is formed by spreading a solution of a fluoropolymer dissolved in a solvent on the surface of water, evaporating the solvent, moving a barrier to form a Langmuir film from the resultant spread film and forming a Langmuir Blodgett film of a fluoropolymer on the surface of a nozzle by a horizontal deposition method.

In the treatment for rendering the surface of the nozzle water-repellent, since the contact angle of water to the surface of the nozzle should be at least 90°, preferably at least 100°, the polarizability is so small that it is indispensable to introduce fluorine having a remarkably small intermolecular cohesive force. Further, in the treatment for rendering the surface of the nozzle water-repellent, a high adhesion is separately required from the viewpoint of use.

The fluoropolymer represented by polyethylene tetrafluoride has excellent features such as heat resistance, chemical resistance and weather resistance. It, however, is insoluble in a solvent, so that, as described above, only powder coating can be applied thereto. Therefore, not only the film strength is low, but also the adhesion at the interface is remarkably low. In recent years, a copolymer of a solvent-soluble polymer with a fluoropolymer and a synthetic polymer having a special fluorine-containing side chain have become prepared. Since these polymers can maintain properties of the conventional fluoropolymers and are soluble in a solvent, a smooth surface free from a pinhole can be easily prepared by coating. In order to attain a film strength and a bonding strength between the film and the substrate derived from the film strength, it is indispensable for the molecular weight to be increased prior to the formation of the film.

Since the Langmuir Blodgett film of a fluoropolymer is a dense film on a molecular level, a very homogeneous water repellent effect can be attained even when the film thickness is small. The surface energy of the Langmuir Blodgett film of a fluoropolymer having a laminate structure of at least one layer is equal to that of a solid film, so that a more complete ink repellency can be obtained. However, in a usual polymer, since the molecular skeleton has a high degree of freedom, the molecule is in a random coil form. In this case, no Langmuir Blodgett film is formed, and even when coating was conducted thick, the strength of the resultant film is smaller than that of the LB film and the homogeneity is poor due to the occurrence of interstice. By contrast, when the fluoropolymer is a polydiperfluoroalkyl fumarate or its copolymer, the molecule takes a rigid rod form due to a great bulk of the side chain, which enables the LB film to be easily formed.

When a Langmuir Blodgett film is formed by spreading a solution of a fluoropolymer dissolved in a solvent on the surface of water, evaporating the solvent, moving a barrier to form a Langmuir film from the resultant spread film and forming a Langmuir Blodgett film of a fluoropolymer on the surface of a nozzle by a horizontal deposition method, only a portion which has been brought into contact with the Langmuir film is rendered ink-repellent and the inside of the nozzle is subjected to no treatment. Even in a failure in operation, the inner diameter of the nozzle is merely reduced by the film thickness of the Langmuir Blodgett film, so that the Langmuir Blodgett film enters the inside of the nozzle by the same distance as the inner diameter of the nozzle at the maximum. The LB film of a fluoropolymer has a thickness of about 10 Å per layer, while the diameter of the nozzle is about several tens of μm, so that there occurs no problem in the practical use.

The LB film of a fluoropolymer has a sufficient film strength. Since the Langmuir Blodgett film is formed by a horizontal deposition method, no layer of water or the like is present between the surface of the nozzle and the Langmuir Blodgett film of a fluoropolymer, so that a satisfactory bonding strength can be obtained. If possible, it is preferred for the film to be heated to a temperature not below the glass transition temperature of the fluoropolymer.

Example H1

FIG. 10 is a schematic view of an ink jet recording head. Numeral 101 designates a pressure chamber which is a portion for obtaining a pressure used in the ejection of an ink by means of a PZT element or a heating element. Numeral 102 designates an ink passage, and numeral 103 designates an ink jet nozzle.

Figure 14A:
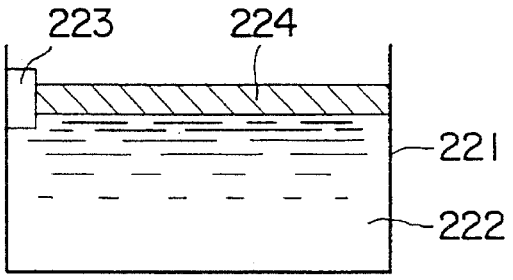
FIG. 14 is a typical cross-sectional view showing the steps of treatment for rendering the surface of a nozzle water-repellent, FIG. 14(*a*) shows a state obtained when polydiperfluoroakyl fumarate is dissolved in a fluorocarbon solvent and the solution spread on the surface of water, FIG. 14(*b*) shows a state obtained after evaporation of the fluorocarbon solvent, FIG. 14(*c*) shows a state obtained when a nozzle is pulled up from the surface of water to transfer the Langmuir-Blodgett film of a fluoropolymer to the surface of the nozzle.
Figure 14B:
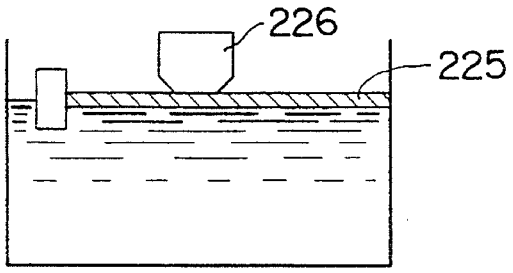
Figure 14C:
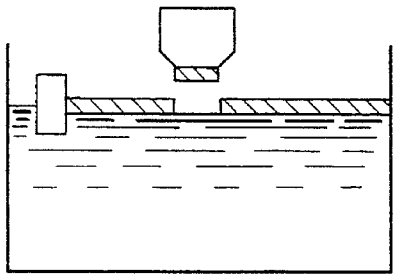

FIG. 14 is a typical cross-sectional view showing the step of treatment for rendering the surface of a nozzle water-repellent. FIG. 14(*a*) shows a state obtained when a polydiperfluoroalkyl fumarate is dissolved in a fluorocarbon solvent and the solution 224 is spread on the surface of water 222 contained in vessel 221.

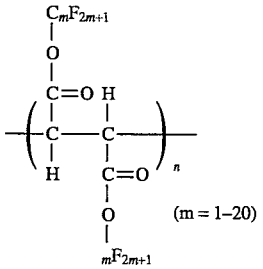

With respect to the concentration of the solution and the amount of dropping of solution, a preliminary experiment was conducted to prepare a π-A curve, the amount of the solution necessary for forming on the surface of water a monomolecular layer having an area of half of the area of the surface of water was calculated, and the solution in the calculated amount was dropped on the surface of water. FIG. 14(*b*) shows a state obtained when after evaporation of the fluorocarbon solvent, a barrier 223 is moved to form a Langmuir film 225 and the surface of a nozzle comprising an acrylic resin in an ink jet recording head 226 is brought into contact with the Langmuir film. It is not always necessary that the surface of the nozzle be brought into contact with the surface of water in a parallel manner, and the surface of the nozzle may be brought into contact with the surface of water in a slightly inclined state. Further, the nozzle may be submerged into the water to some extent. FIG. 14(*c*) shows a state obtained when a nozzle is pulled up from the surface of water to transfer the LB film of a fluoropolymer to the surface of the nozzle.

Figure 15:
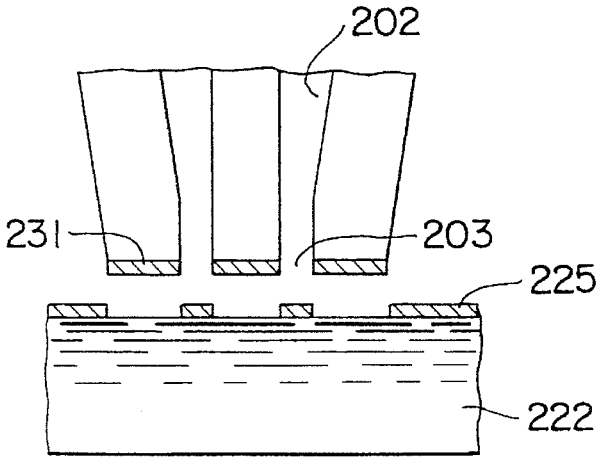
FIG. 15 is an enlarged view of the nozzle portion for jetting an ink shown in FIG. 14(*c*).

FIG. 15 is an enlarged view of the nozzle portion for jetting an ink shown in FIG. 14(*c*). When the surface of the nozzle 203 was brought into contact with the surface of water 222, the LB film 225 of a fluoropolymer 231 was transferred to the surface of the nozzle only at a portion which had been brought into contact with the LB film and the Langmuir film 225 positioned at the hole of the nozzle was left as it was on the surface of water. The transferred film was heat-treated at 150° C. for one hour, and then observed under a microscope. As a result, it was confirmed that the formed thin film was very dense and homogeneous. The film had a contact angle of 110° C. to water, that is, a high water repellency. Further, it was confirmed that the ink passage 202 inside of the nozzle was subjected to no treatment for rendering it water-repellent.

The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in a dye ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a dye ink. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example H2

FIG. 4 is a typical cross-sectional view of an embodiment of an ink jet recording head. Numeral 1 designates a pressure chamber which is a portion for obtaining a pressure used in the ejection of an ink by means of a PZT element or a heating element. Numeral 3 designates an ink jet nozzle. Numeral 31 designates a first substrate provided with a pattern groove for an ink passage. Numeral 32 designates a second substrate. An ink passage is formed by laminating both members on top of the other. Numeral 33 designates a nozzle plate.

FIG. 13 is a typical cross-sectional view showing the step of a treatment for rendering the surface of a nozzle water-repellent. FIG. 13(*a*) is an enlarged view of the vicinity of a nozzle in a nozzle plate comprising nickel not subjected to the treatment. FIG. 13(*b*) shows a state obtained when a high polymer of a polydiperfluoroalkyl fumarate/polydiisopropyl fumarate (4:1) is dissolved in a fluorocarbon solvent, the solution is spread on the surface of water, the spread film is compressed to form a Langmuir film and a Langmuir Blodgett film having a three-layer structure is formed on the surface of a nozzle plate and the Langmuir Blodgett film is heat-treated at 180° C. for one hour. The observation under a microscope has revealed that the formed thin film was very dense and homogeneous. The film had a contact angle of 108° to water, that is, a high water repellency. Further, it was confirmed that the inside of the nozzle was subjected to no treatment for rendering it water-repellent. FIG. 13(*c*) shows a state obtained when the nozzle plate subjected to the above-described treatment for rendering the surface of the nozzle water-repellent and a first substrate comprising a polysulfone resin are washed and dried and then bonded to each other with an adhesive.

The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in a dye ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a dye ink. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example H3

A high polymer of a polydiperfluoroalkyl fumarate/polyvinyl ester copolymer (9:1) was dissolved in a fluorocarbon solvent, the solution was spread on the surface of water, and the resultant film was compressed to form a Langmuir film which was then transferred to the surface of a nozzle in the same manner as that of Example H1. The above step of transfer was repeated four times, and the transferred Langmuir Blodgett film was heat-treated at 120° C. for one hour. The observation under a microscope has revealed that the formed thin film was very dense and homogeneous. The film had a contact angle of 105° to water, that is, a high water repellency. Further, it was confirmed that the inside of the nozzle was subjected to no treatment for rendering it water-repellent.

The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in a pigment ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a pigment ink. As a result, the contact angle of the recording head to water was 95° or more after rubbing the recording head 5000 times. Thus, an ink jet recording head which gives rise to substantially no deterioration of the water repellency and can provide a high setting quality for a long period of time could be realized.

Embodiment I

In the process according to the present embodiment, a coupling compound layer is formed on the surface of a nozzle prior to the formation of a water-repellent layer through transfer. A combination of the above-described transfer method with the formation of a coupling compound layer makes it possible to form a water-repellent layer having an excellent adhesion and a large thickness.

Example I1

A coupling compound layer was formed on the surface of an ink jet recording head comprising glass, silicon, polysulfone or polycarbonate.

γ-Aminopropyltriethoxysilane, N-β-aminomethyl-γ-aminopropyltrimethoxysilane, N-phenyl-γ-aminopropyltrimethoxysilane, N-β-aminoethyl-γ-aminopropyltrimethoxysilane or N-β-aminoethyl-γ-aminopropylmethyldimethoxysilane was used as the coupling compound. A solvent capable of dissolving the coupling compound, for example, methanol, ethanol or water, is used as the solvent. Although the concentration of the coupling compound can be arbitrarily selected, in the present example, the surface of a nozzle was immersed in a 0.2 wt. % solution and drying was conducted at a temperature capable of evaporating the solvent to form a coupling layer.

Then, a fluoropolymer layer (a solution of "CYTOP" (manufactured by Asahi Glass Co., Ltd.) dissolved in a fluorocarbon organic solvent having a high boiling point was formed on the surface of a coupling layer by a transfer method. Specifically, the solution was coated on an elastic body as a support having a smooth surface used in the transfer, such as a silicone rubber, a urethane rubber, a butyrene rubber, gelatin or a chloroprene rubber, by spin coating or uniform pull-up immersion, and a nozzle plate was pressed against the coated surface while regulating the pressure.

Thereafter, this head was baked at a temperature not below the glass transition temperature, for example, 150° C., for the purpose of removing the solvent in the fluoropolymer layer and enhancing the fluidity to improve the coating property. The observation of the surface of the nozzle under a microscope has revealed that the formed thin film was very dense and homogeneous. The film had a contact angle of 110° to water, that is, a high water repellency.

The ink jet recording head thus produced was mounted on a recording device, and a setting test was conducted. As a result, neither omission of dot nor disturbance of setting occurred. That is, it was confirmed that the nozzle was successfully rendered water-repellent. Then, the ink jet recording head was immersed in a dye ink at 70° C. for 5 days, and a setting test was conducted in the same manner as that described above. The setting quality was the same as the initial property. That is, the recording head maintained a sufficient ink repellency. A rubbing test was conducted through the use of a silicone rubber while injecting a dye ink. As a result, the contact angle of the recording head to water was 100° or more after rubbing the recording head 5000 times. Thus, an ink jet recording head which gives rise to substantially no deterioration of the water repellency and can provide a high setting quality for a long period of time could be realized.

Example I2

An ink jet recording head was produced in the same manner as that of Example I1, except that the amorphous fluororesin used in Example I1 was changed to "Teflon AF" (trade name) manufactured by De Pont (E. I.) de Nemours & Co. and the temperature of baking after coating was changed to 180° C.

Example I3

An ink jet recording head was produced in the same manner as that of Example I1, except that the amorphous fluororesin used in Example I1 was changed to "Teflon AF" (trade name) manufactured by De Pont (E. I.) de Nemours & Co. and the temperature of baking after coating was changed to 180° C.

Example I4

A head provided with a coupling layer and a water-repellent layer was produced in the same manner as that of Example I1, except that the surface of the nozzle was previously allowed to stand in oxygen plasma or ultraviolet irradiation atmosphere.

As with the head produced in Example 1, the head thus produced had a contact angle of 100° or more to water after rubbing the head 5000 times. Thus, an ink jet recording head which gives rise to substantially no deterioration of the water repellency and can provide a high setting quality for a long period of time could be realized.

The present invention was described above with reference to examples. Materials used in the ink jet recording head and structures of the ink jet recording head and the kind of the fluoropolymer layer formed on the surface of a nozzle may be varied and are not particularly limited.

Industrial Applicability

The ink jet recording head of the present invention can be widely applied as a recording head to be mounted on an ink jet recording device such as an ink jet printer.

We claim:

1. A process for producing an ink jet recording head for use in an ink jet recording device, comprising subjecting a surface of a nozzle for jetting an ink of the ink jet recording head to a treatment for rendering the surface of the nozzle water-repellent, the process comprising the steps of:

preparing a polymer solution of polydiperfluoroakyl fumarate dissolved in a solvent;

coating through dipping said polymer solution on an entire surface of a nozzle plate provided with an ink jet hole to form a water-repellent layer comprising a fluoropolymer on the entire surface of the nozzle plate; and removing through grinding the water-repellent layer on a surface of the nozzle plate on a side opposite from which an ink is jetted.

2. The process according to claim 1, which further comprises, after forming the water-repellent layer on the entire surface of the nozzle plate, forming a protective layer on at least an inside or vicinity of a jet hole of the nozzle, performing said grinding step and removing said protective layer.

3. A process for producing an ink jet recording head for use in an ink jet recording device, comprising subjecting a surface of a nozzle for jetting an ink of the ink jet recording head to a treatment for rendering the surface of the nozzle water-repellent, the process comprising the steps of:

coating a positive-working resist on at least a reverse side opposite from which an ink is jetted of a nozzle plate provided with an ink jet hole;

irradiating the nozzle plate with an ionizing radiation from the surface side of the nozzle plate with the reverse side surface being light-shielded;

developing the surface which has been irradiated and removing the resist from the surface of the nozzle plate and an inside of the nozzle hole;

coating through dipping a polymer solution containing polydiperfluoroakyl fumarate dissolved therein on an entire surface of the nozzle plate to form a water-repellent layer comprising a fluoropolymer on the entire surface of the nozzle plate; and removing the resist layer and the water-repellent layer on the reverse side surface of the nozzle plate to form a water-repellent layer on only the surface side of he nozzle plate and a surface inside of the nozzle hole.

4. In a process producing an ink jet recording head for use in an ink jet recording device, the process comprising subjecting surface of a nozzle for jetting an ink of the ink jet recording head to a treatment for rendering the surface of the nozzle water-repellent, the process improvement comprising the steps of;

forming a polymer layer comprising a polymer solution containing polydiperfluoroakyl fumarate dissolved therein on a surface of a transfer medium; and transferring the polymer layer formed on the transfer medium to a predetermined portion of the surface of the nozzle for jetting the ink, said surface being provided with an ink jet hole.

5. The process according to claim 4, wherein the transferring of the polymer layer is conducted at least once by spreading the polymer solution containing a fluoropolymer dissolved therein on a surface of water to form a film, evaporating a solvent contained in the polymer solution and bringing the film into contact with the surface of the nozzle.

6. The process according to claim 5, wherein after the transfer of the polymer layer, the transferred polymer layer is heat-treated.

7. The process according to claim 4, which further comprises spreading the polymer solution containing a fluoropolymer dissolved therein on a surface of water to form a spread film, evaporating the solvent, moving a barrier to form a Langmuir film from the spread film and bringing a resultant Langmuir film into contact with the surface of the nozzle to form a Langmuir-Blodgett film comprising at least one layer of a fluoropolymer on the surface of the nozzle.

8. The process according to claim 4, wherein prior to the transfer of the polymer layer, a coupling layer is formed on the surface of the nozzle.

9. The process according to claim 4, wherein a surface of the transfer medium is smooth.

10. The process according to claim 4, wherein a coupling compound layer is formed by immersing a nozzle in a coupling solution comprising a coupling compound and a solvent.

11. The process according to claim 4 wherein after exposure of the nozzle to an ozone atmosphere, a coupling layer is formed and a water-repellent layer is then formed.

12. The process according to claim 4, wherein after exposure of the nozzle to an ozone atmosphere, a water-repellent layer is formed through transfer.

* * * * *